United States Patent [19]

Yanagimoto et al.

[11] 4,106,318

[45] Aug. 15, 1978

[54] METHOD AND APPARATUS FOR ROLLING METALLIC MATERIAL

[75] Inventors: Samon Yanagimoto; Minoru Kawaharada; Shuji Nagata; Fujimasa Koyama, all of Kitakyushu, Japan

[73] Assignee: Nippon Steel Corporation, Kitakyushu, Japan

[21] Appl. No.: 759,868

[22] Filed: Jan. 17, 1977

Related U.S. Application Data

[63] Continuation of Ser. No. 564,894, Apr. 30, 1975, abandoned.

[30] Foreign Application Priority Data

| | | | |
|---|---|---|---|
| Dec. 17, 1974 | [JP] | Japan | 49-145316 |
| May 15, 1974 | [JP] | Japan | 49-54027 |
| May 15, 1974 | [JP] | Japan | 49-54028 |

[51] Int. Cl.[2] ..... B21B 1/00; B21B 1/08; B21B 1/02; B21B 39/06

[52] U.S. Cl. ..... 72/199; 72/252; 72/205; 72/366; 72/234

[58] Field of Search ..... 72/179, 251, 252, 366, 72/250, 199, 224; 164/282

[56] References Cited

U.S. PATENT DOCUMENTS

| | | | |
|---|---|---|---|
| Re. 19,590 | 5/1935 | Coe | 72/252 |
| 723,834 | 3/1903 | Cooper | 72/252 |
| 2,811,060 | 10/1957 | Sendzimir | 72/252 X |
| 3,553,997 | 1/1971 | Schoffmann | 72/199 X |

*Primary Examiner*—Milton S. Mehr

[57] ABSTRACT

In the rolling of metallic material by using a rolling mill having a working roll for each surface of the workpiece reduced and having the shafts fixed with respect to movement in the direction of travel of the workpiece, the workpiece is rolled at such a high reduction rate in cross-sectional area that the contact angle $\theta$ between the working roll and the workpiece can have a value of $\geqq \tan^{-1}\mu$ ($\mu$ being the coefficient of friction between the working roll and the workpiece), and the rolling operation is carried out by pushing the workpiece between the working rolls, so that a neutral point of relative movements between the rods and the workpiece wire remain within the surface along which the working roll and the workpiece contact each other. The rolling apparatus has a device to push the workpiece between the working rolls and a rolling mill or rolling mills of high reduction capacity to roll the thus pushed workpiece at a high reduction rate of the cross-sectional area, whereby there can be rolled strip, bar, wire rod shape, beam blank or the like in a limited number of passes.

11 Claims, 32 Drawing Figures

FLANGE SPREADING RATIO = H1/Ho

| PASS NO. | 1 | 2 | 3 | 4 | 5 | 6 | 7 |
|---|---|---|---|---|---|---|---|
| WEB THICKNESS | 124 | 94 | 64 | 52 | 42 | 34 | 27 |
| AMOUNT OF WEB REDUCTION | 25 | 31 | 30 | 12 | 10 | 8 | 7 |
| FLANGE THICKNESS | 130 | 130 | 127 | 103 | 83 | 67 | 53.5 |
| AMOUNT OF FLANGE REDUCTION | 0 | 0 | 3 | 24 | 20 | 16 | 13.5 |

(mm)

REDUCING ONLY WEB PORTION

REDUCING BOTH OF WEB PORTION AND FLANGE PORTION

METHOD AND APPARATUS FOR ROLLING METALLIC MATERIAL

This is a continuation of application Ser. No. 564,894, filed Apr. 3, 1975, now abandoned.

BACKGROUND OF THE INVENTION

The present invention relates to a method and apparatus for rolling metallic material and more particularly to a method and apparatus for rolling such a metallic workpiece as a plate, bar, wire rod shape, beam blank or the like at a very high reduction rate of the cross-sectional area for one pass.

It is widely and well known that a rolling method using rolls is one of the methods of fabricating metal material into a plate, bar, shape and so on. Said method is widely used because it permits mass production on a continuous basis.

Moreover, in view of the recent trend toward higher productivity in commercial production, the steelmaking industry and other related industries have become interested in such method and are studying it for an improvement of their operations and also for the development of new forms of such method.

This is because, so far as they use the conventional rolling methods, except for such special methods using a planetary mill or a pendulum mill, they cannot attain a high reduction rate of the cross-sectional area of the workpiece, because of poor biting of the workpiece into the pass between the work rolls, slipping of the workpiece on the work rolls and other complications inherent in the conventional methods. Taking one complication as an example for further understanding of such situation, the reduction rate of the cross-sectional area in hot rolling of steel plate according to the conventional methods is not more than 30% for one pass when the plate thickness ratio, that is the ratio of the roll diameter D to the thickness Ho of the workpiece before being rolled, is 5 and the coefficient of friction between the working rolls and the workpiece is 0.36.

Because of such a low reduction rate of the cross-sectional area according to the conventional methods, there are required an increased number of rolling mills or passes in one rolling mill. This naturally leads to a requirement for a larger space for the rolling equipment and a lower size of the material handling equipment (such as a crane and roller a table), of a great variety of spare parts such as rolls for the rolling mill and other equipment, and of a greater number of personnel for operation and maintenance of the equipment. This is a great problem to be solved in view of the social obligation imposed on enterprises to raise funds and to improve efficiency so as to reduce capital expenditures and labor. Moreover, outerprises are also socially obligated to save energy, and thus there is another problem to be solved since an increased number of passes in rolling operations requires a greater amount of power as well as a greater length of time.

The following is a detailed description of the above-mentioned and some other problems in the conventional methods having a low reduction rate of the cross-sectional area for one pass.

According to conventional methods, the width of the rolled product in the rolling operation in one direction is about 1.1 to 1.2 times, the width of the workpiece before being rolled. Therefore, in rolling for a greater width of the rolled product by reducing the thickness according to the conventional methods, there is used a device in which a slab after being rolled or workpieces in a pass while being rolled, are turned 90°in the horizontal plane, and they are rolled again to increase the lateral spreading such an operation being called "cross-rolling".

However, in the case of producing a metal strip of great length and width, the raw material therefor must be sized large enough to produce the proper size of the product strip, that is, the ingot, slab or casting used therefor must be sized large enough. In addition, there are necessary such large-sized apparatus as molds for molding ingots, a slab rolling mill, slab handling equipment and a roller table, a larger size of crane and vast of continuous coating apparatus requiring vast amounts of capital expenditures.

For these reasons, the maximum width of the metal strip according to the conventional methods for rolling in one direction cannot be made greater than about 7134 mm (7 feet).

Even in rolling thick plate, the workpiece must be turned perpendicular to the rolling direction for another rolling operation when it is subjected to cross rolling: Thus, requiring long time and resulting in a low operation efficiency, the great length of time consumed causing additional consumption of fuel for heating the workpiece for the prevention of a drop in the temperature thereof.

Another problem is the need to prepare a great variety of sizes of materials from which to produce a variety of rolled products.

In the rolling a shape from a metal such as steel, a material having a square cross-section (such as a bloom) is rolled in, at least, some ten passes with grooved rolls of a rolling mill. Also, in the rolling of a bloom, billet, rod or the like, it is necessary to use such a great number of passes such as some tins of passes.

The requirement for such great number of passes as described above, is, on one hand, the necessary result of rolling at the 30% reduction rate which is the maximum obtainable without using a tensile-force on the workpiece, and, on the other hand, is for the purpose of permitting the workpiece to be completely bitten into by the grooved rolls used according to the design of rolled product. One of the difficulties with the rolling of steel shapes lies in the shaping of the flange thereof. In order to overcome this difficulty, there have been designed a variety of profiles for rolls, which are part of the important know how for the rolling of steel shapes.

Coming back to the requirement of a great number of passes according to the conventional methods, there arise the following problems therefrom. Because a great number of passes are required in the course of hot rolling, this requires greater space, number of pieces of equipment, spending, and whatever else is required in the way of rolling equipment, accessories, plant, buildings, crane and plant site.

Another problem lies in the requirement for roll profiles having a very complicated design for each type of rolled product, such design requiring designing technique of a high level of skill and long-accumulated experience. Besides, the great number of passes causes the temperature distribution of the workpiece to become deranged to a great degree, such deranged distribution causing not only anisotropy of the material but also production of residual stress and divergence of deformation resistance in the workpiece. These make the design of profiles very difficult.

Also, according to the conventional methods, it cannot be avoided that the width of the flange of a rolled product requires a correspondingly narrow shape for the blank therefor, making it necessary to prepare a wide variety of sizes of blanks, thus making it difficult to control the stock of blanks.

In the blooming operation according to the conventional methods, the difference in size or shape between the steel ingot and the product bloom, must be achieved by a great number of passes, lack of such passes being made a reduction rate between 20 and 30% , and hence, the size or shape is changed by degrees. For example, the rolling of a bloom of 250 mm square from a steel ingot of 610 mm square by using a reversing 2-high mill, requires about 19 passes. Further, in the case of rolling a steel shape having a large size from such a bloom, the preliminary rolling of a beam blank similar to the desired pattern, also necessary, increasing the number of passes by several phases to 20 to 30 passes, thus lowering operation efficiency greatly.

Besides, it is necessary to use a rolling mill and rolls that correspond to the desired size or shape of the rolled product. Particularly, in the case of rolling a billet, there must be an increase in the number of rolling mills and in the variety of rolls, requiring great capital spending and a larger space for facilities.

As described above, there are available methods using a planetary mill or a pendulum mill as methods for the reduction of great amount. As for the planetary mill, the planetary assemblies consist of the cross-section by a two back-up rolls surrounded by a number of small working rolls that are mounted in cages at their extremities. Because the working rolls are travelling around the back-up roll in the direction of the workpiece travel they rotate themselves, so as to roll the workpiece being pushed forward by the feed rolls which are installed ahead of the planetary mill. In the planetary mill, each work roll reduces only a little, but the total amount of reductions made by a plurality of working rolls is great.

The pendulum mill has a working roll set at the tip of its arm swinging periodically in the direction of the travel of the workpiece and in the opposite direction thereto and the workpiece is rolled by the movement of the swinging working rolls, as it is fed stepwise. Thus the reduction of the workpiece by the swinging working rolls of the pendulum mill is only a little at each pass, but reduction is repeated, making the total amount of reduction large.

As described above, the planetary mill as well as the pendulum mill produces a great amount of reduction as a whole, but has the following disadvantages:

As the amount of reduction per working roll or in one pass is small, metal flow is produced only in the vicinity of the part of the workpiece contacting the working roll, causing conspicuously uneven distribution of such flow in the direction of the thickness of the workpiece. Therefore, edge cracking is produced in the extremities of the workpiece where high stress is set up, thus lowering the yield of product. The rolling operations carried out with a plurality of working rolls or repeatedly tends to cause a wavy unevenness on the surface of the product.

As the working rolls travel in the rolling direction, as a practical matter their diameter cannot be made greater than the present size, and therefore, the rigidity in the lateral direction of the work rolls remains low, making it impossible to roll plate having a great width. For example, maximum width of plate which can be rolled in a planetary mill is 1.2 m. Furthermore, these mills have a complicated structure, and produce noise. Particularly in the operation of the planetary mill, it is necessary to have the upper and the lower planetary rolls operate synchronously, requiring a complicated mechanism. Lastly, these rolling mills are capable of rolling plate, but not rod or shapes.

SUMMARY OF THE INVENTION

It is an object of the present invention to provide a method for rolling such metallic pieces as plate, bar, wire rod, shaped beam blanks and so on, at a high rate of reduction of the cross-sectional area in a limited number of passes, say, in one to several passes, making it possible to raise the rolling operation efficiency, save labor, reduce capital expenditures, reduce consumption of energy and improve the quality of the product.

Another object of the present invention is to provide a method for rolling such metallic pieces as plate or shapes at a high reduction rate, while the lateral spreading of the plate or the flange of the shape is being controlled accurately by adjusting the force for continuously pushing the workpiece into the rolling mill and/or the force to continuously pull the workpiece from the rolling mill.

A further object of the present invention is to provide a method for rolling at a high reduction rate to roll shaped pieces at a high operation efficiency.

A further object of the present invention is to provide a method for rolling at a high reduction rate to roll continuous castings into intermediate or final products at a high operation efficiency.

A still further object of the present invention is to provide a method for rolling at a high reduction rate to roll two workpieces connected one with the other, thereby making it possible to hot-roll workpieces in succession endlessly.

A still further object of the present invention is to provide a rolling apparatus containing a rolling mill or rolling mills far rolling at high reduction rate to roll strip, bar, wire rod or beam blanks of high quality at a high operation efficiency.

In order to achieve said objects, the rolling method of the present invention is characterized by rolling metallic material by using a rolling mill having the shafts of the working rolls fixed with respect to movement in the direction of the travel of the workpiece, the rolling steps comprising adjusting the gap between the working rolls so as to provide such a high rate reduction of the cross-sectional area that the contact angle $\theta$ between each working roll and the workpiece will have a value of $\tan^{-1} \mu$ ($\mu$ being the coefficient of friction between the working roll and the workpiece by) and rolling the workpiece pushing the workpiece continuously into said gap between the working rolls by a pushing force such that a neutral point to remains within the surface of the working roll and the workpiece which contact each other.

DESCRIPTION OF THE PREFERRED EMBODIMENTS

According to the conventional rolling methods, driven working rolls bite the workpiece, and as they are reducing it, said rolls feed the workpiece forward in the same direction as the rotation of the rolls by utilizing the friction produced between the surface of the workpiece and that of the working rolls. In order to carry out such rolling operations, it is required that the workpiece be completely bitten between the rotating rolls, and that after having been so bitten, the forwarding speed of the workpiece should not change discontinuously. In order to meet such requirements, the total horizontal component of the frictional force produced between the workpiece and the working rolls that works so as to forward the workpiece toward the exit from the pass must be greater than the horizontal component of the frictional force that works so as to force the workpiece back toward the entry to the pass. Otherwise, the workpiece slips off the working rolls, and no progress in the rolling direction and no rolling operations take place.

Thus, it is a proved theory that rolling operations using driven rolls according to the conventional methods can be performed with consistency of results only when the contact angle $\theta$ and the coefficient of friction $\mu$ both between the working roll and the workpiece, have the relationship represented by:

$$\theta < \tan^{-1}\mu \qquad (1)$$

Figure 1:
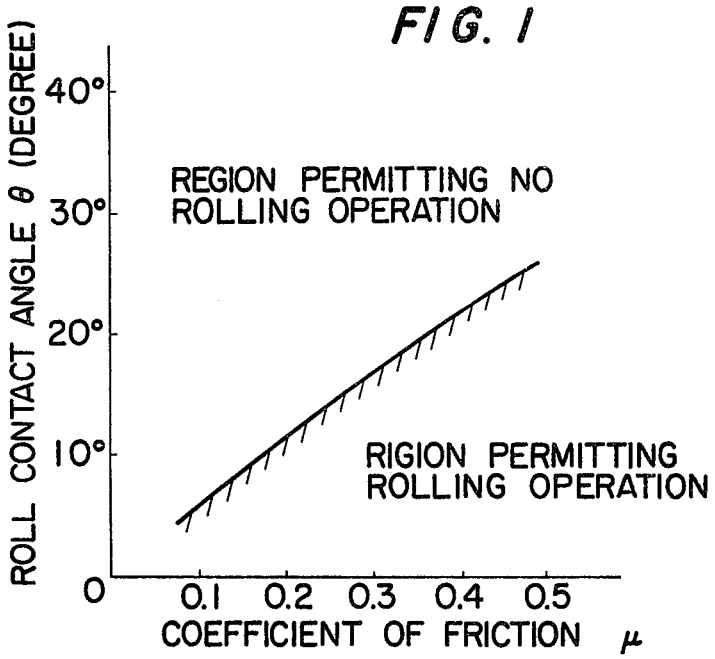
FIG. 1 is a graph showing the range of contact angles in relation to coefficients of friction within which rolling is permitted.

FIG. 1 shows a graph supporting the relation of formula (1), where the curve divides the lower region corresponding to conditions permitting rolling operations and the upper region corresponding to conditions permitting no rolling operations.

In the light of the known principle that the contact angle $\theta$ is geometrically determined in relation to the radius of the working rolls and the amount of reduction, it may be concluded that if the contact angle $\theta$ is below a certain value, the amount of reduction cannot be made greater than a certain level. Because of this limiting factor, the prior art according to such methods as described above, has not permitted rolling at a high reduction rate.

The inventors of the present invention have long conducted research and experiments for the purpose of increasing the amount of reduction in one pass; and they have finally come to the conclusion that the rolling of the workpiece, as it is pushed in between the working rolls, permits a much greater contact angle $\theta$, that is, amount of reduction, than is obtainable by the conventional methods.

In this case, the region corresponding to conditions permitting rolling operations can be generally represented by using the contact angle $\theta$, the coefficient of friction $\mu$ and the compressive stress $\sigma p$ produced on the workpiece by the pushing-in force, as follows:

$$\theta \leqq f_1(\mu, \sigma p/K) \qquad (2)$$

Figure 2:
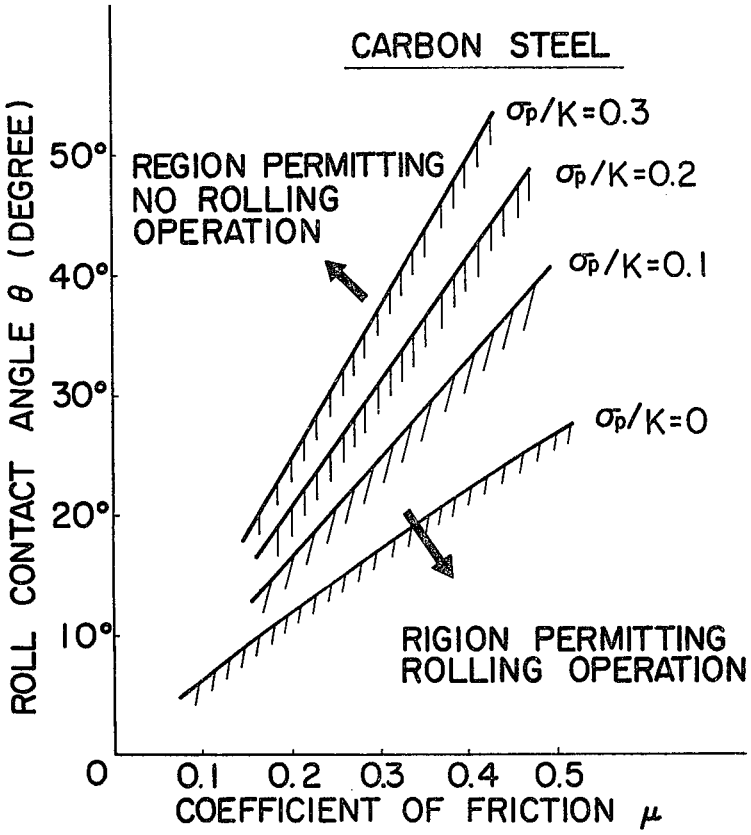
FIG. 2 is a graph showing the condition under which the contact angle that permits the rolling changes depending on the pushing force.

, where $f_1$ represents a function; and K represents the yield stress at the rolling temperature of the workpiece. FIG. 2 shows a graph supporting the relation of formula (2) with a group of curves based on the pushing-in force as parameters, which respectively divide the lower region corresponding to conditions permitting rolling operations from the upper region. As is obvious from this graph, the greater the pushing-in force, the greater the contact angle $\theta$, that is, the amount of reduction.

The application of said pushing-in force to the workpiece is for the purpose of preventing the workpiece from slipping off the working rolls, that is, to perform continuous rolling operations under such operating condition that the neutral point where the surface speed of the working roll is equal to the travelling speed of the workpiece remains within the range in which the surface of said working roll and the workpiece contact each other. For this purpose, however, the pushing device must always be at an operation rate synchronized with the workpiece forwarding speed.

As for the known technology for applying a pushing-in force to the workpiece, as described above there are available feed rolls of the planetary mill. However, according to the present invention, the rolling mill has the shafts of the working rolls, one for each surface of the workpiece which is reduced, fixed set in such manner that the rotating shafts of such rolls are fixed with respect to the direction of travel of the workpiece; therefore, the function of the working rolls according to the present invention is quite different from that of the rolls of a planetary mill, and hence there is a great difference in effect of the application of the pushing-in force between the rolling mill according to the present invention and a planetary mill. Further, it is known that the pushing force is applied to the workpiece at the start of the rolling operation only in order to permit the working rolls to easily bite into the workpiece. However, this technique is quite different from that of the present invention in that the pushing force in the present invention is continuously applied to the workpiece even after the initial biting.

As for the method for pushing the workpiece, there is available the method of pushing the end of the workpiece in the direction into the space between the working rolls. As the source of such pushing force, there are available a hydraulic cylinder or a combination of an electric motor and a link mechanism or a rack and pinion.

Figure 3:
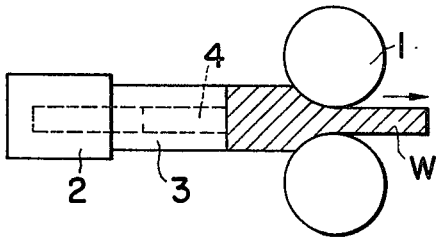
FIG. 3 and FIG. 4 are schematic drawings of a pushing-in device of the present invention.
Figure 4:
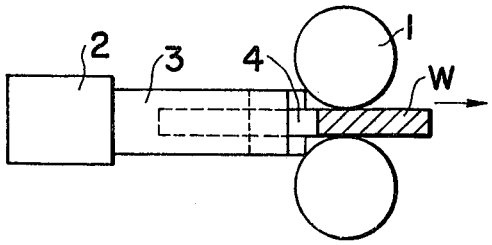

FIGS. 3 and 4 illustrates respectively one such pushing device, where a rod 3 of a hydraulic cylinder 2 functions itself as a hydraulic cylinder, containing another rod 4 within it. Referring to FIG. 4, this construction works operation, just before the contact of the outer rod 3 with the working roll 1, the outer rod 3 works synchronously with the inner rod 4 in applying pushing-in force to the workpiece; and after that the outer rod 3 stops working, while the inner rod 4 continues pushing the workpiece W until the moment when the trailing end of the workpiece W passes between the working rolls 1, and then this rod stops working and returns to the original position for the next operation. The hydraulic cylinders 2 and 3 are controlled by the pressure and flow of hydraulic fluids and other factors by using known controlling circuits, valves and the like.

In addition there are available methods of pushing the workpiece in between the working rolls by gripping the workpiece at the upper surface, the lower surface or both side surfaces with pinch-rolls, caterpillers or the like.

Figure 5:
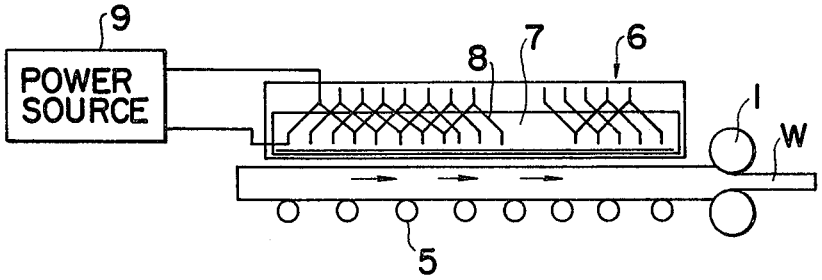
FIG. 5 is a schematic drawing of a pushing-in device utilizing electromagnetic force.

FIG. 5 illustrates one of the methods of pushing the workpiece by utilizing electromagnetic force, in which a linear motor 6 is provided right above the workpiece W placed on a roller table 5; and the core 7 of the linear motor 6 is positioned in the workpiece forwarding direction. As three-phase alternating current is introduced into the winding 8 of the core 7 from a power source 9, an electromagnetic field travelling linearly in the workpiece forwarding direction is produced by the linear motor 6, the thus produced electromagnetic force working as a pushing-in force applied to the workpiece W.

As another pushing-in method, there is available a method, according to which the rolling apparatus has a rolling mill provided ahead of the high reduction rolling mill according to the invention, and the workpiece is delivered from the first rolling mill directly to the high reduction rolling mill, and the surface speeds of the working rolls of both rolling mills are so controlled that the workpiece speed at the outlet of the first rolling mill is higher than that at the inlet of the high reduction rolling mill so as to produce a compressive force on the workpiece, thereby continuously pushing the workpiece in between the working rolls of the high reduction rolling mill. The first rolling mill can, be any rolling mill of the ordinary type, a high reduction rolling mill or an edger.

As still another pushing-in method, there is available a method in which a pusher for pushing the workpiece out of a heating furnace provided ahead of the high reduction rolling mill is utilized also for pushing the workpiece in between the working rolls of the high reduction rolling mill.

Furthermore, in the case of continuously rolling a number of workpieces in succession, a preceding workpiece can have the rear end thereof contact with the forward end of the following workpiece, and a pushing-in force is applied to the following workpiece, so as to push the preceding in workpiece between the working rolls, thereby raising operation efficiency and yield of products.

As described concretely below, the appropriate magnitude of the pushing-in force should be such that the compressive stress produced on the workpiece by such pushing-in force is lower than the yield stress of the workpiece at the rolling temperature; thus buckling of the workpiece before it is bitten by the working rolls can be avoided.

In the case of rolling a metal having no clear or specific yield point, its proof stress can be used in place of yield stress. In order to prevent buckling as mentioned above, such devices as a holding guide and pinch rolls are effective. It is desirable for attaining a constant pushing-in force under regular control that said compressive stress be 0.01 times as great as the yield stress. Thus, the rolling of the workpiece as it is pushed in between the working rolls, as described above, produces a great amount of reduction, that is, a high reduction rate during rolling. The "rolling at high reduction rate" is defined as the rolling of the workpiece gripped between the rotating rolls so as to reduce the cross-sectional area or thickness of the workpiece to the same size as the gap set between these rolls and in which the contact angle $\theta$, which is the angle of the cross-section of the roll subtended by the arc of the roll surface in contact with the workpiece (see FIG. 3), has a value represented by:

$$\theta \geqq \tan^{-1}\mu \qquad (3)$$

Thus, rolling at a high reduction rate means rolling which is performed at a high reduction of the cross-sectional area which cannot be attained in rolling operations according to the conventional methods because the workpiece can not be bitten and easily slips off the working rolls.

Taking for instance the case of hot-rolling steel plate at a D/Ho ratio of 5 (D represents the diameter of the working rolls, and Ho represents the thickness of the plate) and at a friction coefficient $\mu$ of 0.36, the reduction rate attained by the conventional method is less than 30%, so that the rolling at a reduction rate of more than 30% would be called rolling at a high reduction rate for such a steel plate.

The method of the present invention is applicable to a variety of metals at any rolling temperature, irrespective of the variations in cross-sectional shape and size of the workpiece. The following is a concrete explanation of said method applied after the rolling of a steel product.

The pushing-in force to be applied to the steel product which is the workpiece, should be such that the value of the compressive stress $\sigma p$ produced on the workpiece by the pushing-in force satisfies the following formula:

$$1 > \frac{\sigma p}{K} \geqq \frac{1}{a\mu}(\theta - C_1) - \frac{b}{a} > 0 \quad (4)$$

where:

K: yield stress (kg/mm$^2$) produced on the workpiece at the rolling temperature $\theta$: Roll contact angle (rad)

*a:* Constant = 1 - 8

*b:* Constant = 1.5 ~ 0.5

$C_1$: Constant = −0.2 ~ +0.2

The coefficient of friction $u$ appearing in the above formula, is converted, as follows, in the light of formulas of Ekelund and A Geilji compensated for roll lubrication;

$$\mu = \{C_2(1.05 - 0.0005.T) - 0.056\ Vr\}C_3 \quad (5)$$

where:

$C_2$: Constant determined according to the material of the roll (1.0 for forged steel roll; 0.8 for cast steel roll)

$C_3$: Constant determined according to the lubricant for the roll = 1 ~ 0.1

Vr: Rolling speed (m/sec)

T: Rolling temperature (°C)

Said formula (4) represents the pushing-in force which is generally appropriate to a steel product.

In the following description, the rolling particularly of steel plate and flanged steel shapes at a high reduction rate is explained concretely.

Figure 6:
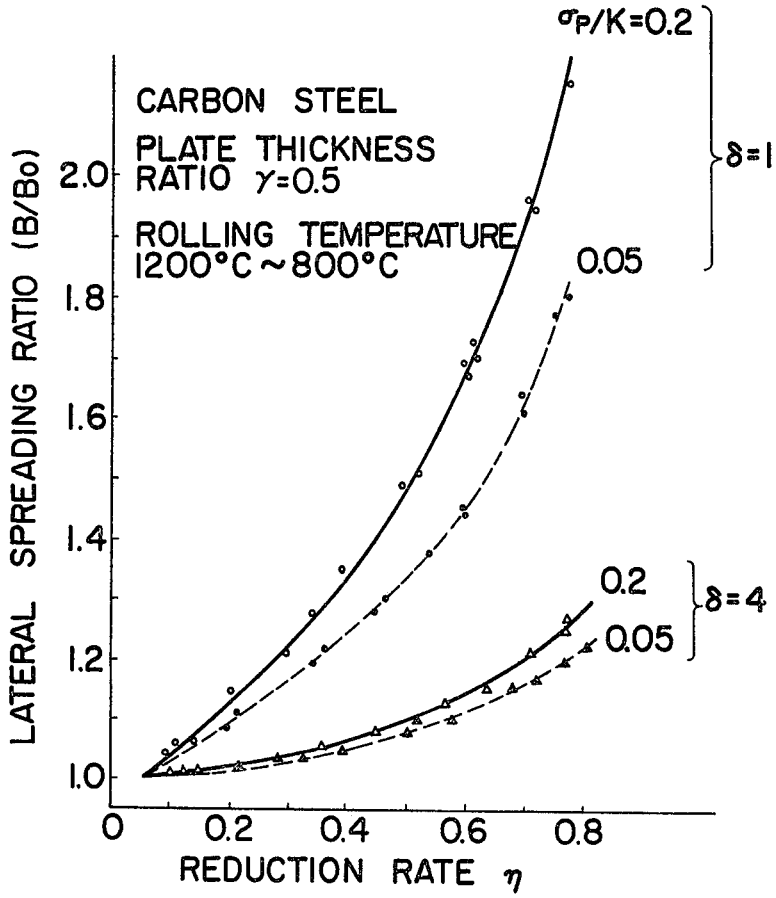
FIG. 6 is a graph showing the relation of the reduction rate and the lateral spreading ratio for steel plate.

The inventors of the present invention have found after experiments with a variety of sizes and objects that the lateral spreading of a steel plate when it is a workpiece is much greater when rolling at high reduction rate than otherwise. Although lateral spreading rate B/Bo (B: Width of the steel plate after being rolled; Bo: Width of the same before being rolled) varies according to the reduction rate $\eta$, the plate thickness ratio $\gamma$ or D/Ho (D: Diameter of the working roll; Ho: Thickness of the steel plate before being rolled, the plate width ratio, $\delta$ or Bo/Ho (Bo: As defined above, the Ho: As defined above) pushing-in force and the coefficient of friction, the lateral spreading rate becomes greater as the reduction rate or pushing-in force becomes greater, up to 3 as a maximum. FIG. 6 shows the change of the lateral spreading rate as the reduction rate and pushing-in force change showing the trend of increasing of the lateral spreading rate.

In the case of rolling steel plate, the pushing-in force to be applied to the workpiece, should be of such magnitude that the value of the compressive stress $\sigma$ p produced on the workpiece by said pushing-in force satisfies the following formula:

$$\frac{B}{Bo} = \left\{1 + a\left(\frac{\sigma p}{K}\right)\right\}(b\,\eta^n + c) \quad (6)$$

where:

$a = d\,\eta + f$

*b:* constant = 0.1 ~ 2.5

*c:* constant = 0.5 ~ 1.5

*d:* constant = 0.9 ~ 1.2

*f:* constant = 0.2 ~ 0.4

*n:* constant = 1.5 ~ 2.5

Figure 7:
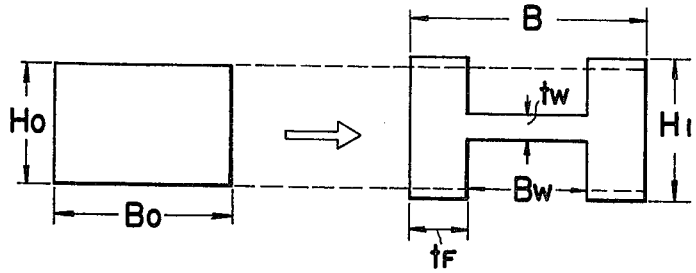
FIG. 7 is a diagram for showing the lateral spreading ratio of the flange portion of an H-shaped steel member

Also, in the case of rolling a flanged steel shape, the flange portion of the workpiece has as great a lateral spread as a result of the rolling at a high reduction rate, as obtained in the case of rolling steel plate. Thus, while the lateral spreading rate, H/Ho (H: Average width of the flange: Ho : thickness of the workpiece before being rolled refer to FIG. 7) varies according to the rate of reduction of the cross-sectional area, the size of the workpiece before being rolled, the coefficient of friction and the pushing-in force, the lateral spreading rate becomes greater particularly as the pushing-in force becomes greater. FIG. 7 is a diagram showing the relation between the lateral spreading rate and the pushing-in force in the case of rolling an H-shape member.

In the case of rolling a steel shape, a greater lateral spreading rate means that the workpiece will fill up the profile of the rolls better, making the cross-sectional shape of the rolled product better.

Figure 8:
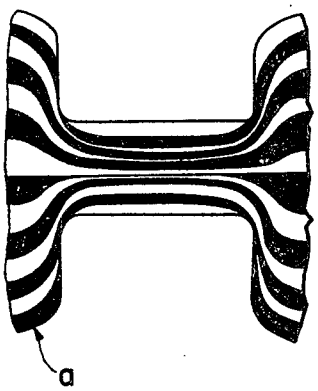
FIG. 8 PRIOR ART
FIG. 8 and FIG. 9 are cross sectional diagrams of an H-shaped member which have been rolled by a conventional method and the method of the present invention.

FIG. 8 is a cross-sectional view of an H-shape member rolled according to the conventional rolling methods (without using a pushing-in force), It is a product of one-pass rolling of the workpiece having a square cross-section by a universal rolling mill. The rolling at such reduction rate was obtained without applying a pushing-in force because the workpiece was a plastic material having a high coefficient of friction $\mu$. It is obvious in view of this drawing that in the rolling without applying a pushing-in force, the filling-up of the profile of rolls with the flange portion of the workpiece is not fully attainable only, that is, said flange portion is rolled into a deformed shape.

Figure 9:
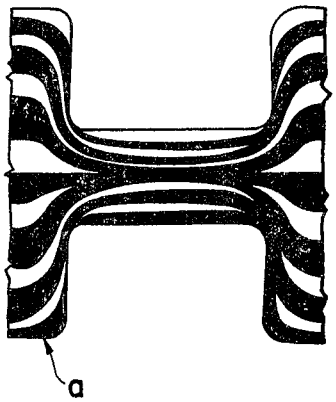

FIG. 9 shows the cross-section of an H-shape member rolled by the method of the present invention. The rolling of said shape was achieved in one pass of a workpiece having a square cross-section, as in the above case, but by applying a pushing-in force.

As can be seen in this drawing, the rolling of the workpiece by continuously applying a pushing-in force between the rolls, is successful in filling up the profile of the rolls, that is, the thus rolled flanged portion (a) has a good cross-sectional shape.

Figure 10:
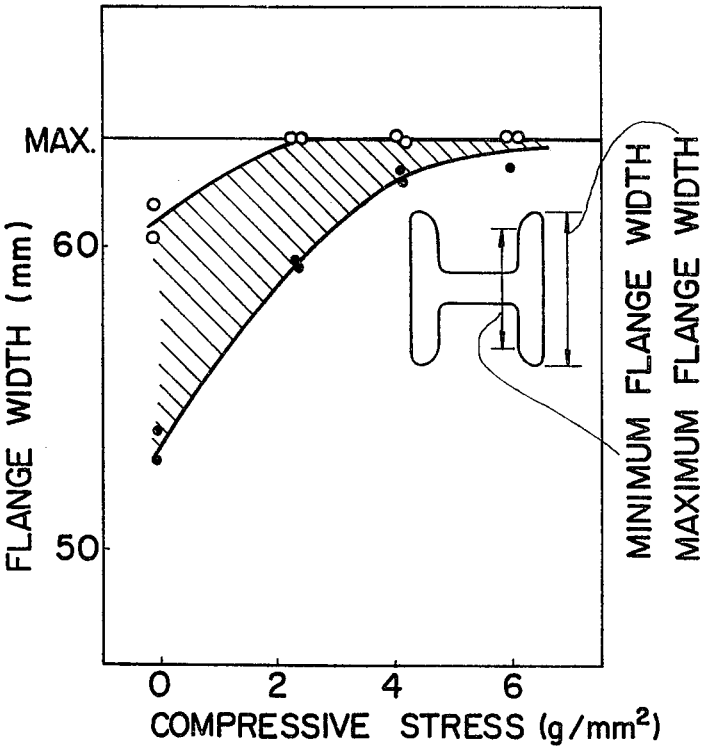
FIG. 10 and FIG. 11 are graphs showing the relation of the pushing-in or compressive force and the flange width of the H-shaped material.
Figure 11:
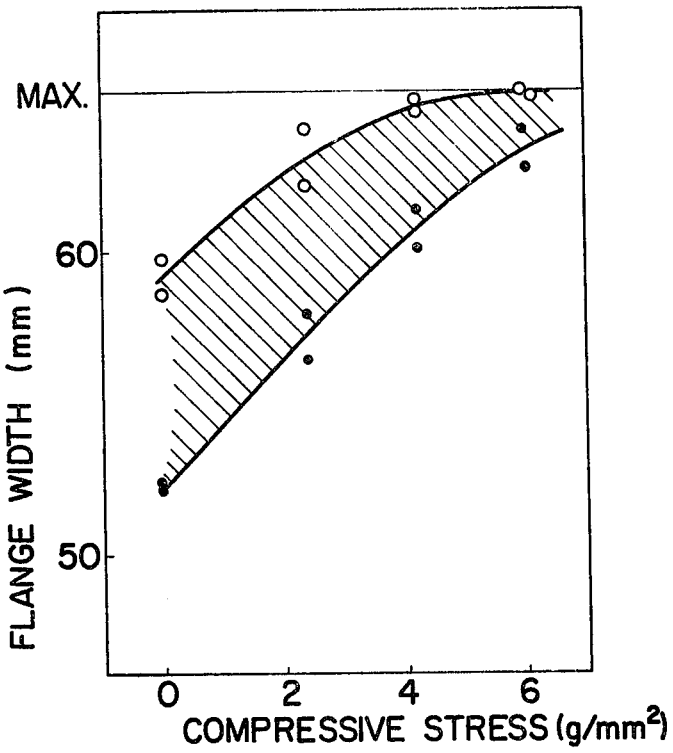

FIGS. 10 and 11 show the relation between the compressive stress produced on the workpiece by the pushing-in force and the width of the flange of the H-shaped member.

In the rolling operations to obtain the date shown in these drawings there was used a universal plasticine mill. The workpiece used in the rolling operation of FIG. 10 was sized 55 mm thick × 50 mm wide with a web 8 mm thick and 61 mm high, and in the graph the circles are for maximum width of the flange and the dot are for the width thereof. The workpiece used in the rolling operation of FIG. 11 was 55 mm thick × 50 mm wide, with a 11 mm thick and of 61 mm high, and in the graph the circles are for the maximum width of the flange and the dots are for the minimum width thereof.

In these drawings, the maximum width is equal to the distance between the walls of the profile of the rolls.

In order to attain such good filling-up of the profile of rolls by the workpiece in the rolling of the steel shape, it is the desirable in connection with the rolling conditions that the reduction rate of the cross-sectional area be more than 30%. Also, the pushing-in force should be of such magnitude that the value of the compressive stress $\sigma p$ produced on the workpiece by said pushing-in force satisfies the following formula:

$$C_F = a\eta + {}^{*}\, b\,(\sigma p/K) + d \qquad (7)$$

where: $C_F$: coefficient of the flange width $$C_F = \frac{1}{H_1}\ \frac{HoBo - TwBw}{B - Bw}$$

Ho : thickness of the workpiece before being rolled
Bo: width of the workpiece before being rolled
$H_1$ : desired flange width
B : web width
Tw: web thickness
Bw : width of web inside
$\eta$ : web reduction rate $$\eta = \frac{(Ho - Tw)}{Ho}$$

*a* : constant = 0.5 ~ 6.0
*b* : constant = −0.1 ~ −6.0
*d* : constant = 1 ~ 4

Figure 12:
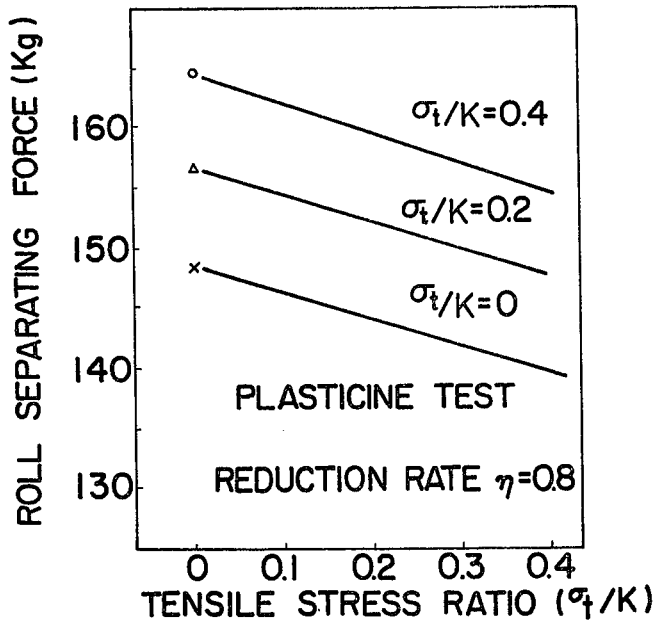
FIG. 12 is a graph showing the relation of the tensile as pulling force and the roll separating force.

As mentioned above, the rolling of the workpiece at a high reduction rate of cross-sectional area can be achieved by continuously pushing the workpiece in between the working rolls. However, the rolling at such a high reduction rate increases rolling load. The inventors of the present invention had conducted research on ways of preventing the increase of the rolling load until they finally found that during the rolling of the workpiece, if the workpiece is continuously pulled at the exit side of the rolling mill, this is successful in checking the increase of the rolling load. FIG. 12 is a graph showing the decrease of the rolling load as a result of the increase in the pulling force. The pulling force to be applied in this case should be of such magnitude that the tensile stress $\sigma$ produced on the workpiece by said pulling force is lower than the yield stress of the workpiece at the rolling temperature.

Figure 13:
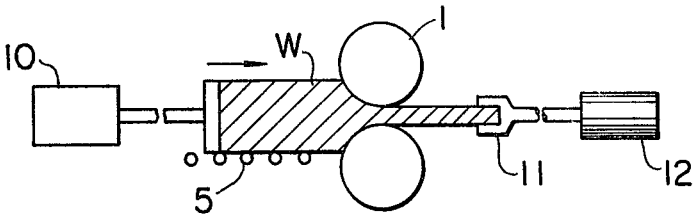
FIG. 13 is a schematic drawing of a high reduction rolling mill of the present invention which is provided with a pushing-in device and a pulling device.

FIG. 13 shows one embodiment of an apparatus for performing the rolling at such a high reduction rate as described above, where the workpiece W is subjected to rolling at a high reduction rate by being continuously pushed in between the working rolls 1 by the hydraulic cylinder 10, and also the rolled product is gripped at the leading end by a gripping device 11 on the exit side of the rolling mill and pulled out from between the rolls by the hydraulic cylinder 12. It should be understood that the particular ways of pushing-in and pulling are not limited to the above-described ways; there are such devices as pinch rolls, catapillars, a combination of a gear and rack and a linear motor, that are all useful, depending on operation conditions.

In continuous rolling operations, the surface speed of the working rolls of each rolling mill may be so adjusted as to continuously apply both a pushing-in force and a pulling force to the workpiece. In other words, the surface speed of the working rolls of rolling mills installed respectively before and after the high reduction rolling mill can be made higher than that of the working rolls of the high reduction rolling mill, thereby continuously applying both a pushing-in force and a pulling force to the workpiece respectively at the entry side of the high reduction rolling mill and at the exit side thereof.

In this case, the rolling mill at the entry side of the high reduction rolling mill reduces the workpiece without using the pushing-in force. Therefore, the reduction capacity of this rolling mill should desirably be the same as that of a conventional rolling mill, but it need not be as much.

The width of the workpiece is somewhat reduced by the continuous pulling at the exit side of the rolling mill.

Figure 14:
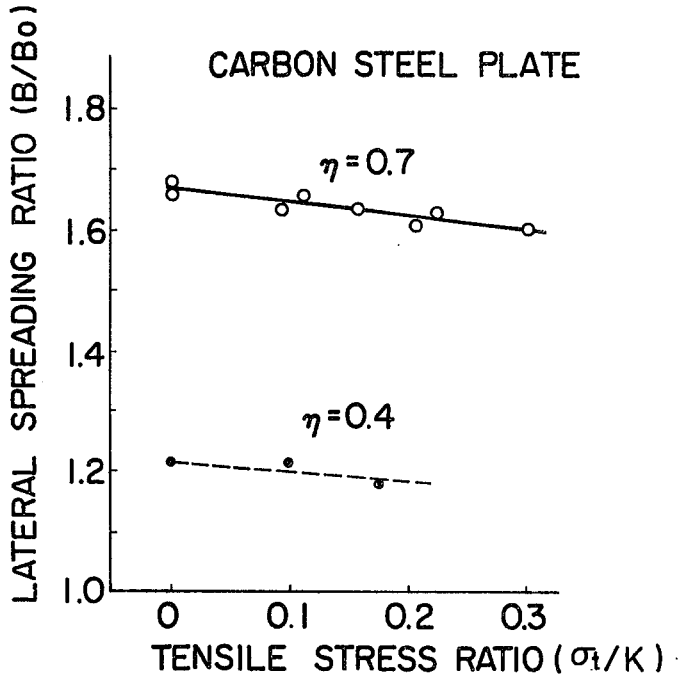
FIG. 14 is a graph showing the relation of the tensile or pulling force and the lateral spreading ratio of a steel plate.

In the case of rolling steel plate, the lateral spreading rate, B/Bo (B: Width of the workpiece after being rolled; Bo: Width of the workpiece before being rolled). varies according to the reduction rate $\eta$ the plate thickness ratio $\gamma$ , the plate width ratio, the pushing-in force, the pulling force, the coefficient of friction and other factors; and FIG. 14 shows one case of the reduction of the width of the plate due to the pulling force.

Figure 15:
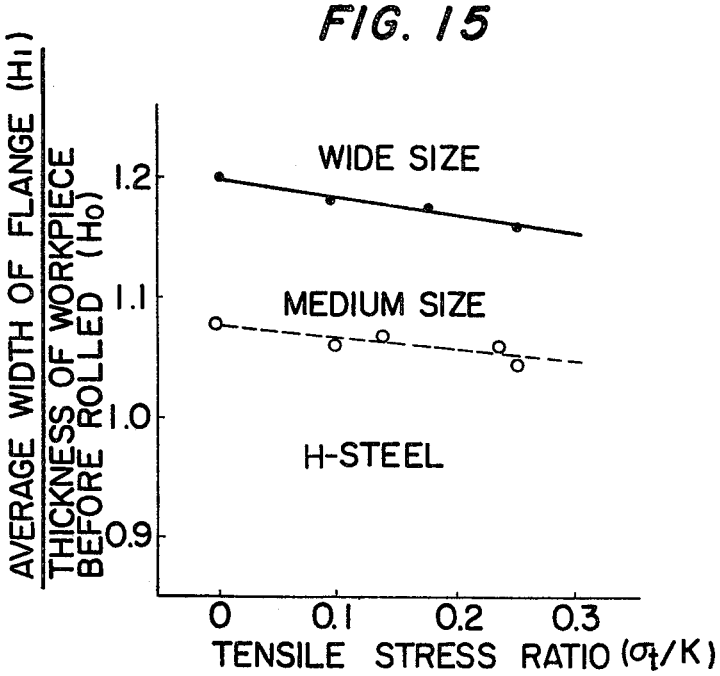
FIG. 15 is a graph showing the relation of the tensile or pulling force and the lateral spreading ratio of the flange portion of an H-shaped steel member.

In the case of rolling a flanged steel shape, the lateral spreading rate, H/Ho (H: Average width of the flange of the rolled product: Ho : Thickness of the workpiece before being rolled as seen in FIG. 15) varies according to the reduction rate of the cross-sectional area, the size of the workpiece, the size of the rolled product, the coefficient of friction, pushing-in force, the pulling force and other factors. FIG. 15 is a graph covering one case of the reduction of the width of the flange according to the pulling force applied to the H-shaped steel member.

In the case of rolling steel product at a high reduction rate by continuously applying a pushing-in force and a pulling force, it is necessary that the pushing-in force be of such magnitude that the compressive stress $\sigma p$ satisfies said formula (4) and that the pulling force should be of such magnitude that the tensile stress $\sigma t$ produced on the workpiece by said pulling force satisfies the following formula:

$$\frac{Ot}{K} = \left(\frac{\theta}{S_1}\right)\cdot\left(\frac{Pt}{K}\right) - \left(\frac{So}{S_1}\right)\left(\frac{\sigma p}{K}\right) \qquad (8)$$

where: K : yield stress of the workpiece of the rolling temperature (kg/mm²)
$\theta$ : roll contact angle (rad)
So: cross-sectional area of the workpiece before being rolled (mm²)
$S_1$ : cross-sectional area of the workpiece after being rolled (mm²)
Pt : separating force (kg)

Also, in the case of rolling steel plate, it is necessary in order to control the width of the plate that the pushing-in force should have a magnitude such that the compressive stress $\sigma p$ satisfies the following formula (9), and that the pulling force should have a magnitude such that the tensile stress $\sigma t$ satisfies the following formula (10):

$$\left(\frac{B}{Bo}\right) = 1 + a\left(\frac{\sigma p}{K}\right)(b\eta^n + c) \qquad (9)$$

-continued $$\left(\frac{B}{Bo}\right) = g\left(\frac{\sigma t}{K}\right) + \left(\frac{B}{Bo}\right)\sigma t = 0 \quad (10)$$

where;

Bo : width of the workpiece before being rolled

B : width of the workpiece after being rolled K : yield stress of the workpiece at the rolling temperature $a = d\,\eta + f$ $d$ : constant=0.9 ~ 1.2

$f$ : constant=0.2 ~ 0.4 b: constant=0.1 ~ 2.5 c: constant=0.5 ~ 1.5 n : constant=1.5 ~ 2.5

$(B/Bo)_{\sigma t=0}$ : lateral spreading rate at tensile stress $\sigma t=0$ $g$ : constant=−0.05 ~ −0.8

In the case of rolling flanged steel shapes, the desirable rolling condition for achieving good filling up of the rolls profile with the workpiece as described above is that the role of reduction of the cross-sectional area is more than 30%; and it is necessary in consideration of the reduction of width of said workpiece that the pushing-in force should have a magnitude such that the compressive stress 6p satisfies the following formula (11), and that the pulling force should have a magnitude such that the tensile strength $\sigma t$ satisfies the following formula (12);

$$C_F = a_1\eta + b_1\left(\frac{\sigma p}{K}\right) + d \quad (11)$$

$$\frac{H_1}{Ho} = a_2\left(\frac{\theta t}{K}\right) + \left(\frac{H_1}{Ho}\right)\sigma t = 0 \quad (12)$$

where :

$$C_F = \frac{1}{H_1}\ \frac{HoBo - TwBn}{B - Bw}$$

Ho: thickness of the workpiece before being rolled

Bo : width of the workpiece before being rolled $H_1$ : desired flange width

B : web width

Tw: web thickness

Bw : width of web inside $\eta$ : web reduction rate = (Ho − Tw/Ho)

$a_1$ : constant=0.5 ~ 6.0

$b_1$ : constant=−0.1 ~ −6.0

$d$ : constant=1 ~ 4

$a_2$ : constant=−0.1 ~ −0.9

$(H_1/Ho)_{\sigma t=}0$: lateral spreading rate of flange at tensile stress $\sigma t=0$ As described above, the rolling of plate or a flanged shape at a high reduction rate by pushing the workpiece in between the working rolls, causes said workpiece to spread laterally to a large degree, such lateral spreading increasing as the reduction rate or pushing-in force increases. In view of this effect, the rolling according to the present invention is so carried out so as to adjust the reduction rate at one pass in cross-sectional area of one pass and/or the magnitude of the pushing-in force applied to the workpiece during operation, thereby controlling the lateral spreading of the workpiece. Rough control of the lateral spreading control can be achieved by adjustment of the rate of reduction of the cross-sectional area and the magnitude of the pushing-in force and fine control can be achieved by adjustment of the magnitude of the pushing-in force. In addition, the pulling force may be adjusted as well as the pushing-in force and the rate of reduction of the cross-sectional area so as to achieve more accurate control than described above.

In the case of rolling plate and a rectangular workpiece according to the present invention, the width of the rolled product resulting from spread, can be freely adjusted between 1.1 to 3.0 times the original size of the workpiece.

Particularly in the case of controlling the width of steel plate as it is being rolled, the pushing-in force is adjusted so that the compressive stress $\sigma p$ due to the pushing-in force satisfies said formula (6). Furthermore, in the case of adjustment of the pulling force as well as the pushing-in force, the pulling force is adjusted so that the tensile stress $\sigma t$ produced by the pulling force satisfies said formula (10).

In the case of controlling of the width of a flanged steel shape by the adjustment of only the pushing-in force, the pushing-in force is adjusted so that the compressive stress $\sigma p$ produced by the pushing-in force satisfies said formula (7). Furthermore, in the case of adjustment of the pulling force as well as the pushing-in force the pulling force, is adjusted in so that the tensile stress $\sigma t$ produced by the pulling force satisfies said formula (12).

Figure 16:
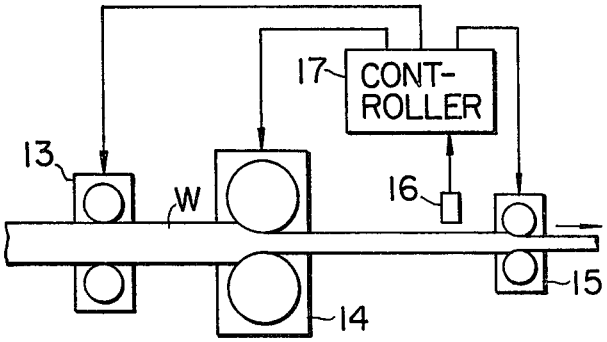
FIG. 16 is a schematic drawing of a rolling installation of the present invention which performs lateral spreading control.

FIG. 16 shows one embodiment of the rolling apparatus according to the present invention which operates to control the lateral spreading of the workpiece and wherein the workpiece W is continuously pushed into the high reduction rolling mill 14 by pinch rolls 13 and pulled out of said rolling mill 14 at the exit side by pinch rolls 15. Just after the high reduction rolling mill 14 there is provided a width detector 14 with a device such as a photoelectric tube for detecting the width of the workpiece being rolled. The amount of reduction of the work rolls achieved by the high reduction rolling mill 14 and/or the surface speed of the working rolls thereof, and the surface speed of the pinch rolls 13 and 15 are controlled by a controller 17 using feed-back signals from the width detector 16, so as to obtain the desired width of the rolled product.

In the case of continuous rolling operations using the arrangement of a rolling mill in series with and ahead of the high reduction rolling mill, the magnitude of the pushing-in force applied to the workpiece continuously pushed into the high reduction rolling mill can be controlled by the adjustment of the respective surface speeds of the two rolling mills; therefore, the lateral spreading of the workpiece can be controlled by the adjustment of the surface speed of the working rolls. Likewise, in an arrangement of two rolling mills in series respectively before and after the high reduction rolling mill, the control of the lateral spreading of the workpiece is achieved by the adjustment of the respective surface speeds of the working rolls of the three rolling mills.

The advantages of the rolling operation at a high reduction rate, which is explained in detail above has the following advantages.

In view of deformations of the workpiece produced by the rolling at a high reduction rate, metal flow in the direction of thickness of the workpiece is large and relatively uniform, because of the great amount of reduction in one pass through the working rolls, and pushing continuously on the workpiece avoids the production of edge crack. Thus, the damage to the surface of the workpiece dcreases greatly during the rolling at a high reduction rate. As the deformation of the care of the workpiece is great, it is possible to roll continuous castings of a wide variety in kind and size. The surface of the rolled product is not waved, therefore, producing an extremely good surface finish. The lateral spreading of the workpiece can be controlled by the adjustment of the pushing-in force or the pulling force applied to the workpiece. The deformation of the top and bottom of the workpiece is small enough to raise the yield of rolled product. It is possible also to roll a workpiece having a great width. No noise is produced during the operation. The control of the shape of the rolled plate can be achieved in the same manner as in the conventional rolling methods.

From the standpoint of operation efficiency, the desired shape can be obtained in one pass or after a small number of passes, greatly reducing the time required for rolling operations.

In further regard to the apparatus for such rolling operations, a smaller number of rolling mills are required because of the reduced number of passes.

The high reduction rolling mill, the pushing device, the pulling device and the other devices for use in such rolling operations can be known types, and no new devices are required.

As for power consumption for such rolling operations, there is no influence on power consumption due to the increase of the rolling head resulting from the rolling at a high reduction rate by applying a pushing-in force to the workpiece; on the contrary, total power consumption decreases. As for the rolling load, it can be decreased by applying a pulling force in the way as described above.

There is a disadvantage in said rolling, in that the rolling mill must be sized large enough to perform the rolling at a high reduction rate, but said disadvantage is made up for by the abovementioned advantages.

Embodiments of the high reduction rolling according to the present invention will be described in the following.

EMBODIMENT 1

In the rolling apparatus as shown in FIG. 13, the working roll diameter was 1000 mm $\phi$ and the speed of rotation of the rolls was 9.6 r.p.m. The blank was a steel bloom and its cross sectional dimension was 200 × 900 mm, and its length was 1000 mm. This bloom was rolled in one pass to obtain a rolled material the dimensions of which were 40 mm in thickness and 1090 mm in width after the rolling at a rolling temperature of 1200° C while cooling the surface of the rolls with water. At this time, the compressive stress due to the pushing-in force applied to the workpiece was 1.5 kg/mm$^2$ at the time of bite and during the progress of the rolling operation, and the pushing-in force was 270 tons. The reduction in cross-section was 80%, and the power consumption was 13000 KW and satisfactory rolling was carried out.

Also, under the rolling conditions described in the foregoing, the pulling force producing a tensile stress of 1.4 kg/mm$^2$ on the workpiece was applied to the workpiece during the rolling. At this time, the power consumption was reduced by 13% yet satisfactory reduction was carried out.

EMBODIMENT 2

Figure 17:
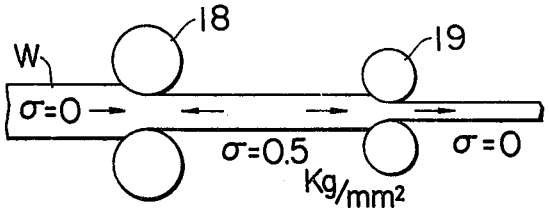
FIG. 17 and FIG. 18 are schematic drawings of high reduction rate rolling operations in which the pushing-in force or the pulling force is applied to the workpiece.

The rolling apparatus was a continuous rolling installation in which rolling mills 18 and 19 capable of a high rate of reduction were arranged in series as shown in FIG. 17. The rolling blank 18 was steel slab and the cross sectional size was a 100 × 500 mm and its length was 5000 mm and the temperature of the blank was 1280° C. The blank was rolled by in one pass of the first rolling mill 18 to a rolled material having a cross sectional size of 85 × 505 mm and a length of 5800 mm, and then was rolled in one pass of the second rolling mill 19 to a rolled material having a cross section of 17 × 611 mm and a length of 24000 mm. The rate of reduction in the first rolling mill 18 was 15% and the rate of reduction in the second rolling mill 19 was 80%. The surface speed of the working rolls of the first rolling mill 18 was faster by 2% than the speed for a non-tension condition, and the pushing-in force was such that a compressive stress of 0.5 kg/mm$^2$ was applied to the rolled material (W) disposed between the rolling mills 18 and 19. Under the foregoing conditions, satisfactory rolling was carried out, and the power consumption was reduced by about 6% as compared with the conventional rolling method and the rolling time was shortened by about 62%.

EMBODIMENT 3

Figure 18:
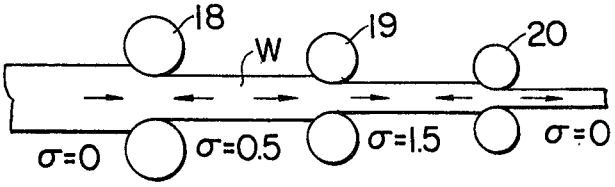

As shown in FIG. 18, the rolling apparatus was obtained by adding a rolling mill 20 capable of high rolling reduction to the apparatus shown in FIG. 17, and the blank was identical with the one used in Embodiment 2. The dimensions of the rolled material W at the discharge side of the each rolling mill were such that the cross sectional size at the discharge side of the first rolling mill 18 was 72 × 505 and the length was 5800 mm, and the cross sectional size at the discharge side of the second rolling mill 19 was 17 × 611 mm, and the length was 24000 mm, and the cross sectional size at the discharge side of the third rolling mill 20 was 13.6 × 586 mm, and the length was 31400 mm. The draft in the rolling mills was 15%, 80% and 20% respectively. A compressive stress of 0.5 kg/mm$^2$ was applied to the rolled material W between the first rolling mill 18 and the second rolling mill 19 similar to the Embodiment 2. Also, between the second rolling mill 19 and the third rolling mill 20, the pulling force was applied to the rolled material W by making the surface speed of the working rolls of the third rolling mill 20 faster by 7% as compared with that for non-tension operation so that the tensile stress became 1.5 kg/mm$^2$. As a result, satisfactory rolling was carried out, and the power consumption of the motor for the high reduction rolling mill was reduced by about 13% as compared with the conventional rolling method.

EMBODIMENT 4

The rolling mill employed was provided with a pushing-in device for the high reduction rolling mill. The blank was a steel billet the cross sectional size of which was 55 × 50 mm, and the blank heating temperature was 1200° C. This billet was rolled in one pass with high reduction to an H-shaped steel member having a flange width of 65 mm, a web thickness of 8 mm, a web width of 60 mm, and a flange thickness of 7 mm. The rate of reduction of the cross-sectional area at this time was 53.5% and the pushing-in force applied to the rolled material was 5.8 tons which produced a compressive stress which was 25% of the yield stress on the rolled material. Under the foregoing rolling conditions, satisfactory rolling was carried out.

Next, a description will be given of some rolling methods utilizing the characteristics of the high reduction rolling method.

First, a description will be given with respect to the universal rolling method for an H-shaped steel member.

Figure 19:
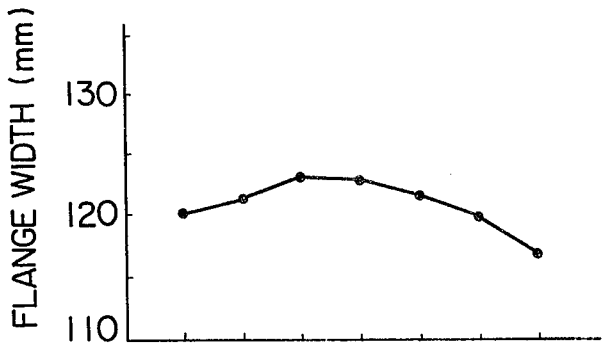
FIG. 19 is a graph showing the relation of the rolling pass and the flange width in the rolling of an H-shaped steel member by a universal rolling mill.
Figure 20:
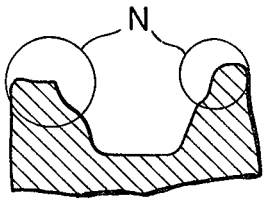
FIG. 20 is a partial cross sectional view of an H-shaped steel member having a deformed flange portion which has been deformed by frictional force.

The shaping of the flange portion of the H-shape steel member by the conventional universal rolling method was carried out by producing metal flow from the web to the flange when the web portion was rolled down by the horizontal rolls. Accordingly, as shown in FIG. 19, when rolling H-shaped steel members with a universal rolling mill, the flange width was first increased by rolling only the web portion. However, when reducing the web portion only by rolling it with the horizontal rolls, the reduction force in the horizontal direction was not applied to the flange portion, and therefore, as shown in FIG. 20, deformation due to frictional force occured on the portion N of the flange by the perpendicular portion of the end of the horizontal rolls, and satisfactory shaping of the flange portion was not achieved. Under such circumstances, in the conventional rolling method, shaping was applied to the flange portion, and then the reduction of the flange portion was increased, and it was thought that a pass could be made that would overcome the deformation by the friction force by the end portion of the horizontal rolls, but when such a pass was carried out, as will be obvious from FIG. 19, the flange width became smaller, contrary to expectations, and there arose problems of maintaining the shape and dimensions of the flange portion.

The present inventors found with respect to the deformation by frictional force on the inside of the flange portion that, in the conventional method, if the reduction of the web portion was carried out first by the horizontal rolls which were forcedly revolved and having a roll diameter larger than that of the vertical rolls, and thereafter, the reduction of the flange portion was carried out by the vertical rolls which were not driven but were caused to follow, as a result, at the time when the reduction of the web portion started, there was no restriction on the flange portion from the horizontal direction, and accordingly the deformation due to the frictional force occurred on the portion of N shown in FIG. 20, and they discovered the rolling method described hereinafter on the basis of the foregoing discovery. The method of the present invention is different from the conventional method and is characterized in that the reduction of the web portion is carried out by follower vertical rolls which are not driven and the reduction and elongation of the flange portion of the rolled material are carried by the horizontal surface of the end portion of the vertical rolls and horizontal rolls which are forcedly driven. By this arrangement, the reduction of the flange portion is started first by the horizontal rolls the roll diameter of which is relatively bigger, and the reduction of the web portion is caused by the vertical rolls under the condition in which the flange portion is restricted by the upper and lower horizontal rolls, whereby the phenomenon of deformation by the frictional force occurring inside of the flange portion never occurs.

When the universal rolling method for H-shaped steel members according to the present invention is performed by the upper and lower horizontal rolls which are forcedly driven and undriven follower vertical rolls, the rolling in an conventional H-type posture changes to rolling in an I-type posture.

However, in this case, when the rolling is carried out by applying the heavy reduction to the web portion of the rolled material by the undriven follower vertical rolls and producing a light reduction of the flange portion by the horizontal rolls which are forcedly driven, there are cases in which slips occur on the surface of the rolls and the rolling cannot proceed.

In order to solve the problem, the high reduction rolling process according to the present invention is used. Namely, the workpiece is rolled at high rate of reduction of the cross-sectional area while continuously pushing the rolled material between the working rolls of the universal rolling mill by the pushing-in device provided ahead of the universal rolling mill. The application of the pushing-in force to the workpiece is to prevent the slips between the surfaces of the working rolls and the workpiece, and at the same time to increase the lateral spreading of the flange portion and to improve the shape of the flange portion.

Also, simultaneously with the application of the pushing-in force to the workpiece, the workpiece is pulled out at the discharge side of the universal rolling mill and the increment of the separating force due to the pushing-in force can be reduced.

As methods of applying the pushing-in force and/or the pulling force to the workpiece, the pushing the bottom of the workpiece (refer to FIG. 3 and FIG. 4), gripping the workpiece (refer to FIG. 16), utilizing electromagnetic force (refer to FIG. 5) and adjusting the surface speed of the working rolls in the continuous rolling (refer to FIG. 17 and FIG. 18) can be utilized.

Figure 21:
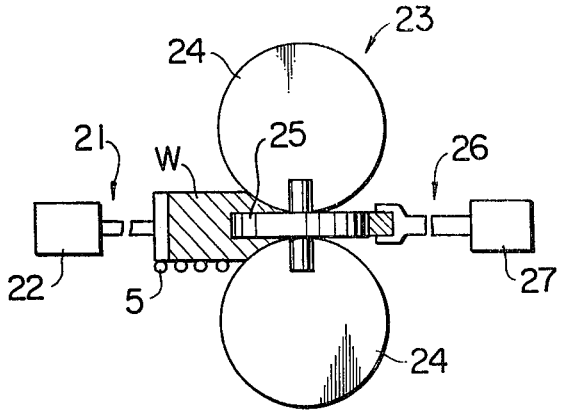
FIG. 21 and FIG. 22 are a schematic side view and front elevation, respectively, rolling equipment according to the present invention for rolling an H-shaped steel member and which is provided with a pushing-in device and a pulling device.
Figure 22:
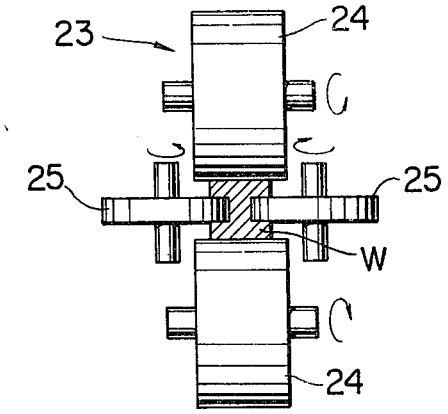

FIG. 21 and FIG. 22 show one example of the rolling apparatus for rolling H-shaped steel members according to the present invention. In the drawings, the trailing end of the workpiece W on the roller table 5 is pushed at into the pass formed by the horizontal rolls 24 and vertical rolls 25 of the universal rolling mill 23 by the pushing-in device 21 including the hydraulic cylinder 22. The horizontal rolls 24 are forcedly driven. The vertical rolls 25 are not driven but are capable of following, namely, are rotatable by the frictional force exerted thereon by the workpiece W, and also the diameter of the vertical rolls 25 is smaller than that of the horizontal rolls. The web portion of the workpiece W is reduced by the vertical rolls 25 and the flange portion is reduced by the upper and lower horizontal surfaces of the horizontal rolls 24 and the vertical rolls 25. Also, the workpiece W is gripped at its leading end by the pulling device 26 including the hydraulic cylinder 27 and is pulled through the apparatus.

An embodiment of the universal rolling method for H-shaped steel members described in the foregoing will be described in the following. Embodiment 5.

The blank material is a steel billet having a thickness of 55 mm and a width is of 50 mm. A universal rolling mill was employed which had the roll arrangement as shown in FIG. 22, the roll diameter of the upper and lower horizontal rolls of which are 480 mm $\phi$ and the diameter of the right and left vertical rolls of which was 300 m $\phi$, namely, consisting of upper and lower horizontal rolls 24 forcedly driven and undriven follower vertical rolls 25 and which was provided with a pushing-in device 21 having the hydraulic cylinder 22 as shown in FIG. 21. The cross-section of the web portion of the workpiece W was reduced by the vertical rolls 25 and the cross-section of the flange portion was reduced by the horizontal rolls 24. The rolled product had a flange width of 60 mm, a flange thickness of 1.5 mm and a web thickness of 10 mm and was obtained by one pass by the rolling operation. The rolling conditions for this rolling was as follows:

| | |
|---|---|
| Reduction rate of cross-section 1 area | : 25% |
| Power consumption | : 45 KW |
| speed of revolution of rolls | : 10 r.p.m. |
| Pushing-in force on the workpiece | : 5.8 ton (0.25 times of yield stress) |
| Rolling temperature | : 1200° C |

In this embodiment, a blank having a square cross section was rolled into an H-shaped steel member in one pass, but the method is not necessarily limited to a one pass operation, and the object of the present invention can be achieved by using a plurality of passes.

EMBODIMENT 6

A 2-high rolling mill having flat rolls with a roll diameter of 200 mm $\phi$ was disposed at the incoming side of the universal rolling mill having the same construction as that employed in the Embodiment 5, and a billet having a rectangular cross section 69 mm thick and 49 mm wide and of a material the same as the material used in the Embodiment 5 was rolled. The speed of rotation of the rolls of the 2-high rolling mill was controlled to push in the workpiece into the universal rolling mill by the 2-high rolling mill, and the working rolls of the 2-high rolling mill were caused to contact the upper and lower surfaces of the workpiece. As a result, the product could be obtained without any trouble.

The actual performance of the rolling in this operation was as follows:

| Rolling mill | 2-high rolling mill | Universal rolling mill of roll arrangement according to present invention |
|---|---|---|
| reduction | 20% | Reducton rate of cross-sectional area 35% |
| speed of revolution of rolls | 25.0 r.p.m. | 10.0 r.p.m. |
| Power consumption | 10.3 KW | 43 Kw |

In this rolling, the surface speed of the working rolls of the 2-high rolling mill was made faster by 4% than the speed which would produce no compressive force on the workpiece, and the rolling was carried out with a compressive force of about 1.0 kg/mm$^2$on the workpiece between the two rolling mills.

Figure 23:
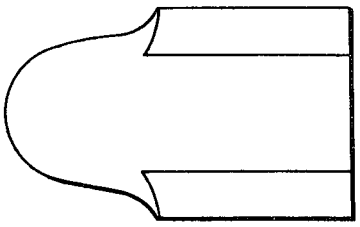
FIG. 23 and FIG. 24 are schematic drawings showing the top of an H-shaped steel member rolled by conventional method and the method of the present invention.
Figure 24:
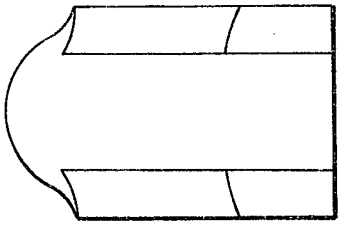

The leading end in the rolling direction of the H-shaped steel member produced by the rolling method according to the present invention had a shape as shown in FIG. 24, and the yield was improved because the length of the tongue portion on this end was much shorter than the length of the tongue portion on the leading end of an H-shaped steel manufactured by the conventional rolling method as shown in FIG. 23.

The present invention has been described with respect to the rolling with a conventional universal rolling mill, in which the posture of the H-shaped steel member at the output side of the universal rolling mill is that of an I-shape member, namely, the flange portion was rolled by the horizontal rolls which were forcedly driven and the web portion was rolled by undriven vertical rolls, but rolling the workpiece in the normal posture of the H-shaped member by relatively small diameter horizontal rolls which are forcedly driven, would not be contrary to the gist of the present invention.

Also, the rolling method of the present invention has been described as being for H-shaped steel members, but there is no doubt that the present invention can be applied to the rolling of shaped steel having shapes similar to H-shaped steel members, for example, to the rolling of the rails, and the like.

Next, a description will be given rolling utilizing the casting heat from the continuous casting of the metallic materials, namely rolling in which the high reduction rolling by an in-line-reduction method is employed.

In continuous casting, it is desirable that the casting speed be increased to improve the production efficiency, but when the casting speed is increased, so called bulging occurs due to the static pressure of the molten metal and which causes the surface portion of the casting to bulge. When the bulging occurs, the solid phase portion immediately below the melting point closer to the liquid phase undergoes tensile distortion due to the bending deformation because of the bulging, and as a result, internal cracks occur.

Molten metal in which impurities such as sulfur and the like are concentrated enters the internal cracks and solidifies, and these portions in turn become defects in the quality of the material. Accordingly, the casting speed cannot be increased beyond a certain degree. For this reason, various countermeasures are taken such as making the pitch of the guide rolls as small as possible.

On the other hand in the field of in-line reduction, there are advantageous points such as that the casting heat can be utilized or the material dimension can be easily changed by the adjustment of the roll reduction, and therefore thus has been an object of study by researchers. In the in-line-reduction method, two rolling methods can be considered, namely, a rolling method in which the rolling is carried out after the metal is completely coagulated (hereinafter briefly referred to as post coagulation rolling) and a rolling method in which the rolling is carried out while an uncoagulated portion remains in the center portion (hereinafter briefly referred to as the liquid core rolling). In case of the liquid core rolling, the internal cracks tend to occur due to the rolling depending upon the rolling conditions even though no internal cracks are present on account of the bulging. In general, as the rate of reduction is increased the more the chances for the occurrence of the internal cracks, but when it exceeds a certain limit (about 30%), it is found that the internal cracks no longer occur. On account of the presence of the internal cracks, in many cases post coagulation rolling is employed in the in-line-reduction method.

In the present invention, one or a plurality of rolling mills including high reduction rolling mills are disposed at the output side of the continuous casting machine, and a compressive stress is generated on the casting between the rolling mills to carry out liquid core rolling at a high rate of reduction, and the internal cracks due to the bulging are prevented to thereby improve the casting speed, and thus a material having an internal quality which is good can be obtained. Now, a more detailed description will be provided with respect to the case where a unit of rolling mills is provided as the rolling apparatus, in which unit the surface speed of the working rolls of each rolling mill is adjusted and the compressive stress is generated on the casting between the rolling mills, and the rolling of the casting is carried out at relatively low reduction rate of the cross-sectional area in the first rolling mill and the third rolling mill and at a relatively high reduction rate of more than 30% in the second rolling mill. The first and/or the third rolling mills may be omitted or another rolling mill may be added.

The first rolling mill is designed to push the casting into the second high reduction rolling mill, and for this purpose, if the rate of reduction of the incross-sectional area in the first rolling mill is more than 3%, it is sufficient. Also, the pushing-in of the casting can be carried out by the pinch rolls of the continuous casting machine, and the first rolling mill may be omitted.

In the second high reduction rolling mill, the rolling of the casting at a rate of reduction of the incross-sectional area of more than 30% is for preventing progressive internal cracks. It is considered that even though the internal cracks occur, the molten metal having the concentrated impurities entering the cracked portions is squeezed out due to the high reduction and is adhered to the cracks.

Also, in the present invention, the compressive stress in the rolling direction is generated in the casting, but due to the compressive stress, tensile stress should not occur in the inner part of the casting, and not only can the internal cracks occurring at the time of rolling be prevented but also the generation of internal cracks caused by the bulging can be prevented. Furthermore, due to the compressive force, the bite of the casting by the second rolling mill is assisted to make possible the rolling at a high reduction rate, and also the consumption of power can be reduced.

Now, an embodiment of the in-line-reduction method according to the present invention will be described in which a steel slab having cross sectional dimensions of 200 × 1000 mm was cast by a continuous casting machine of the vertical bending type, the radius of curvature of the cast slab of which was 10.5 m, and was rolled at a rate of reduction of the cross-sectional area of 5% by a first rolling mill installed at the point where the slab starts to be flattened, and was successively rolled at a rate of reduction of the cross-sectional area of 66.7% by a second rolling mill installed after the first rolling mill. During the rolling operation, the speed of the casting at the outlet of the first rolling mill was made faster by 2% as that of the casting at the inlet of the second rolling mill to produce compressive stress on the casting. The diameter of the work rolls was 1000 mm for both the rolling mills. Whereas when the rolling was not done, internal cracks occurred at a casting speed of 1.2 m/min, the rolled casting had almost no internal cracks when acted on at the same casting speed to carry out the foregoing rolling. The casting was cooled uniformly after the high reduction rolling and had improved quality.

A method of continuous hot rolling of a steel plate (i.e. a slab, a bloom, a billet, and rolled material produced in a rolling process) utilizing the high reduction rolling of the present invention will be described.

In the conventional method of hot rolling of a steel piece, the steel members of the unit length are supplied to the rolling mill intermittently one piece at a time. The trouble occurring in the rolling operation during the intermittent operation as described in the foregoing occurs most frequently when the leading end of the steel piece enters the inlet of the rolling mill or the guiding device of the inlet of the coiler, and in order to prevent such trouble, the rolling speed is lowered at every such occasion. And once the trouble occurs, a great deal of time is wasted in the correction thereof. As a result, not only is there a deterioration of productivity but also a loss of energy and of yield are unavoidable.

The present invention has confirmed, as a result of many reviews and much effort in order to eliminate the foregoing difficulties, that higher productivity can be obtained by effecting the continuous hot rolling by sequentially connecting the steel pieces beforehand for introducing the steel pieces into the rolling mill and that an improvemnt in the quality of the goods and an improvement in the yield thereof can be obtained because irregularity in thickness due to the off-balance of the speed of the rolling mill at the leading trailing portions of the rolled piece is reduced.

The present inventors confirmed as a result of numerous experiments that if the end surface of the leading end of the succeeding steel piece was applied under pressure against the trailing end surface of the preceding steel piece and that part of the periphery of the abutting surfaces thereof was locally fixed and connected by a method such as welding, that thereafter the rolling could be effected at a high reduction rate while applying the pressure, whereby the surfaces of the steel pieces are completely and integrally joined.

Figure 25:
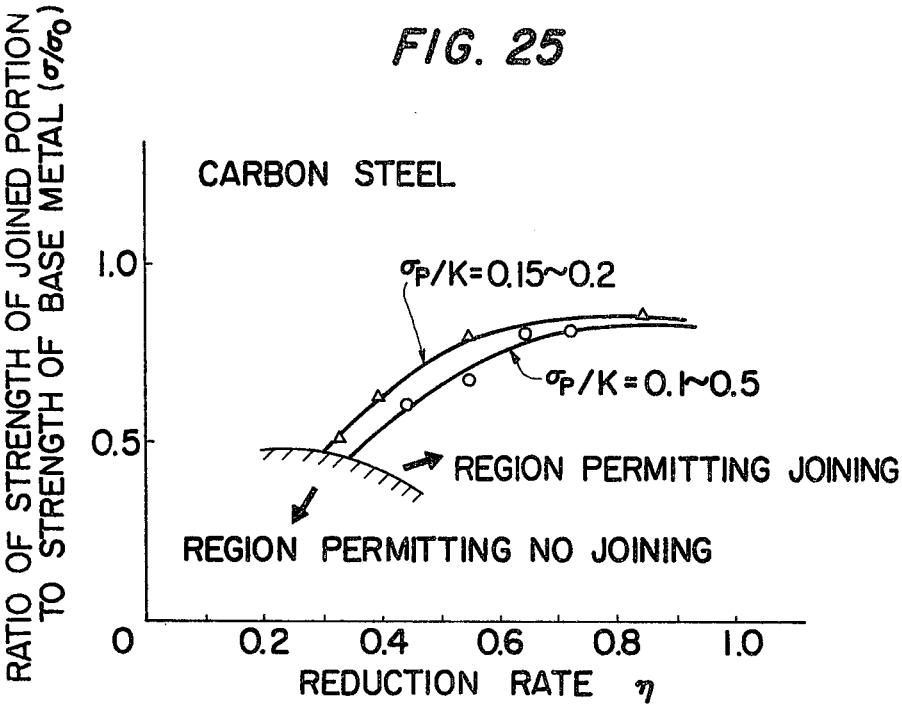
FIG. 25 is a graph showing the relation of the reduction rate and the strength of the portion of the steel members which are joined under reducing pressure.
Figure 26:
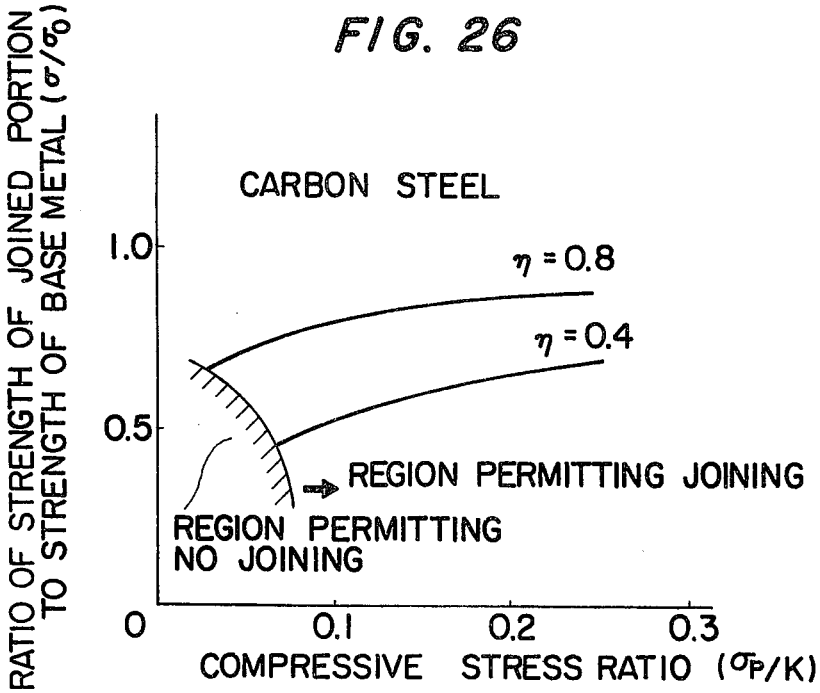
FIG. 26 is a graph showing the relation of the pushing-in force and the strength of the portion of the steel pieces which are joined under reducing pressure.

According to the experiments, in order to join two steel pieces integrally, the steel pieces are required to be rolled at a relatively high reduction rate, and for this purpose, the steel pieces must have the pushing-in force applied thereto as described in the foregoing. Also, the strength of the joined portion of the two steel pieces becomes higher as the reduction rate or the pushing-in force becomes greater as shown in FIG. 25 and FIG. 26. Also, it is necessary that the compressive stress $\sigma p$ (kg/mm$^2$) due to the pushing-in force and the rate of reduction of the cross-sectional area satisfy the following formula:

$$\frac{\sigma}{\sigma o} \leqq a\eta^{n_1} + b\left(\frac{\sigma p}{K}\right)^{n_2} + c \qquad (13)$$

where:

$a$: constant = 0.2 ~ 2.0
$b$: constant = 0.5 ~ 3.5
$c$: constant = −1.5 ~ +1.5
$n_1$: constant = 0.2 ~ 1.5
$n_2$: constant = 0.5 ~ 1.5
$\sigma$: desired strength of joined portion (kg/mm$^2$)
$\sigma o$: deformation resistance of base metal (kg/mm$^2$)
$\eta > 0.3$
$1 > \sigma p/K \geqq 0.02$ This aspect of the invention will be further described in detail in the following. In carrying out the method of the present invention, the steel piece from the continuous casting machine or the blooming mill apparatus or the steel piece obtained from the process of rolling cut by a shearing device provided at the output side of the respective apparatuses or provided in the middle of the rolling line.

It is preferable to remove the scale from the sheared surface of the steel piece before the connection and to smooth its surface. Also, it is preferably that the connecting surfaces be at a mutually high temperature. For this purpose, the cleaning or smoothing or removal of the scale or elevation of temperature is carried out by an oxygen jet or other gas or fluid. Those processes are carried out almost simultaneously on the trailing end surface of the preceding steel piece and the leading end surface of the succeeding steel piece, and the surfaces thereof which are opposed are welded along the periphery of the connecting surfaces while pressure is applied with the assistance of the pushing-in device or means such as the pushing-in, rolling mill, the edger or the pinch rolls, and thereafter they have applied the required compressing force and then the rolling thereof is carried out.

By the foregoing process, the preceding steel piece and the succeeding steel piece are joined under pressure, but, the higher reduction rate at the connection time is preferably, and it is preferably above 30%.

The compressive stress produced on the steel piece due to the pushing-in force is preferably above 0.05 $kg/mm^2$.

The present invention will be described further with respect to some specific embodiments. In the hot rolling line, a steel slab extracted from the heating furnace was descaled by a scale breaker and high pressure water, and then spot welding of 20 $\phi$ mm was carried out each of the sides of the slab while the succeeding slab end surface was urged against the end surface of the preceding slab, and then the slab was rolled at a reduction rate of 50% by the roughing mill while the pushing-in force was applied by means of a pushing-in device which produced a compressive stress of 1.0 $kg/mm^2$ on the slab by. The succeeding slab was completely joined with the peceding slab by the rolling, and in the following rolling operation, the hot rolling was able to be completed continuously without rupture of the rolled material.

Next, a description will be given of a rolling apparatus utilizing the high reduction rolling mills of the present invention which perform the rolling at the high reduction rate as described in the foregoing.

The hot rolling apparatus for strips

Figures 27, 28, 29:
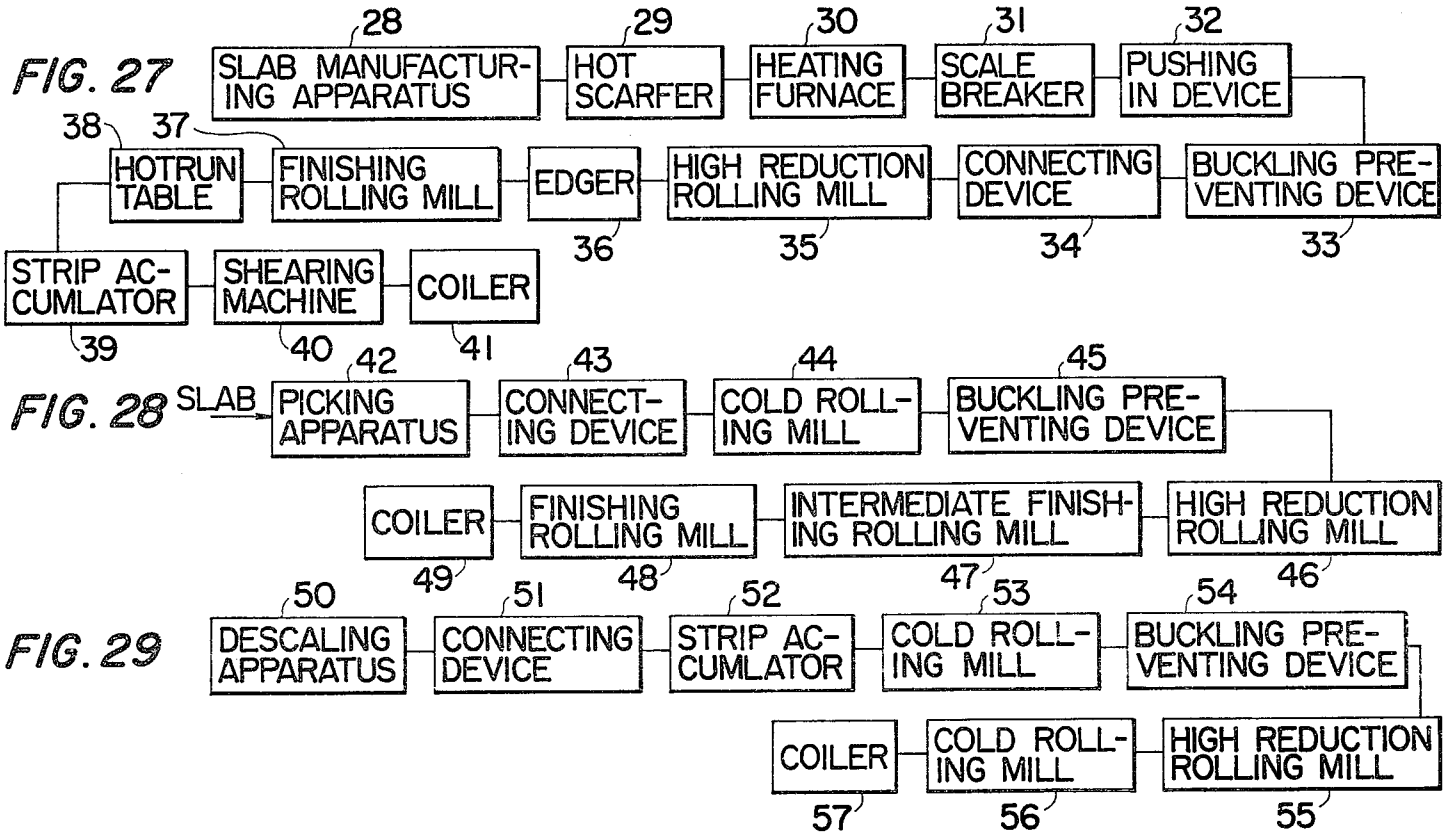
FIG. 27 through FIG. 32 are block diagrams a hot rolling apparatus for strips, a cold rolling mill for a train of strips, a blooming rolling mill train, a steel bar rolling mill train, and a beam blank producing apparatus, respectively, each of which is provided with the high reduction rolling mill of the present invention.

In FIG. 27, a hot scarfer 20 for performing removal of scar from a slab is provided at the output side of a slab manufacturing apparatus 28 consisting of a continuous casting machine or a blooming rolling apparatus. After the hot scarfer 29, a heating furnace 30 and a scale breaker 31 are provided, and a pushing-in device 32 for applying the pushing-in force to the slab, a buckling preventing device 33, a connecting device 34 and a high reduction rolling mill 35 are successively positioned. The buckling preventing apparatus 33 is to prevent the buckling of the slab by the pushing-in force, and for this purpose pinch rolls, side guide rolls, or guide plates can be utilized. The connecting device 34 connects the front and rear edges of the slabs by welding for the purpose of connecting the slabs as described above. As the pushing-in device 32, a normal rolling mill or edger for rolling the side faces may be employed. Flat rolls or grooved rolls may be used for the edger. The high reduction rolling mill 35 is capable of reversing rolling, following this mill are provided an edger 36 for shaping the material and a finishing rolling mill 37 after the finishing rolling mill 37, a hot run table 38, a strip accumulator 39 a shearing machine 40 and a coiler 41 are provided.

In the foregoing apparatus, the scale breaker 31, buckling preventing device 33, edger 36, strip accumulator 39, and shearing machine may be omitted and also a plurality of the high reduction rolling mills 35 and finishing rolling mills 37 may be provided. The scale breaker 31 may be utilized as the pushing-in device. Furthermore, the pulling device may be provided immediately after the high reduction rolling mill 35.

It is apparent that modifications and alternations of the hot rolling apparatus as shown in FIG. 27 are within the scope of this invention.

Cold rolling apparatus for strips

In FIG. 28, after a to pickling apparatus 42 for removing the scale from a slab, a connecting device 43 and a normal cold rolling mill 44 are provided. After cold rolling mill 44, a buckling preventing device 45 and a high reduction rolling mill 46 are provided, and the surface speed of the working rolls of the cold rolling mill 44 is adjusted to apply the pushing-in force to the rolled plate. After to the high reduction rolling mill 46, an intermediate finishing rolling mill 47, a finishing rolling mill 48 and a coiler 49 are provided. The foregoing rolling mills, 44, 46, 47, 48 may each be a plurality of mills, and also the intermediate finishing rolling mill 47 may be omitted. A pushing-in-device may be installed ahead of the cold rolling mill 44, by which the slab is pushed into the high reduction rolling mill 46.

Cold rolling apparatus for strips

In FIG. 29, after a descaling apparatus 50, for descaling hot rolled strips, a connection device 51, a strip accumulator 52 and a normal cold rolling mill 53 are provided. After the cold rolling mill 53, a buckling preventing device 54 and a high reduction cold rolling mill 55 are provided and the strip is pushed into the high reduction rolling mill adjusting the surface speed of the working rolls of the cold mill 53. After the high reduction rolling mill 55, a finishing cold rolling mill 56 and a coiler 57 are provided. The foregoing rolling mills 53, 55, 56 may be a plurality of mills, and also the cold rolling mill may be omitted. A coiler may be provided instead of the strip accumulator 52 and the coil wound by the coiler may be reduced by the cold rolling mill 53.

It is apparent that obvious modifications and alternations of the cold rolling apparatus for strips as shown in FIG. 29 are within the scope of this invention.

Blooming rolling apparatus

Figures 30, 31, 32:
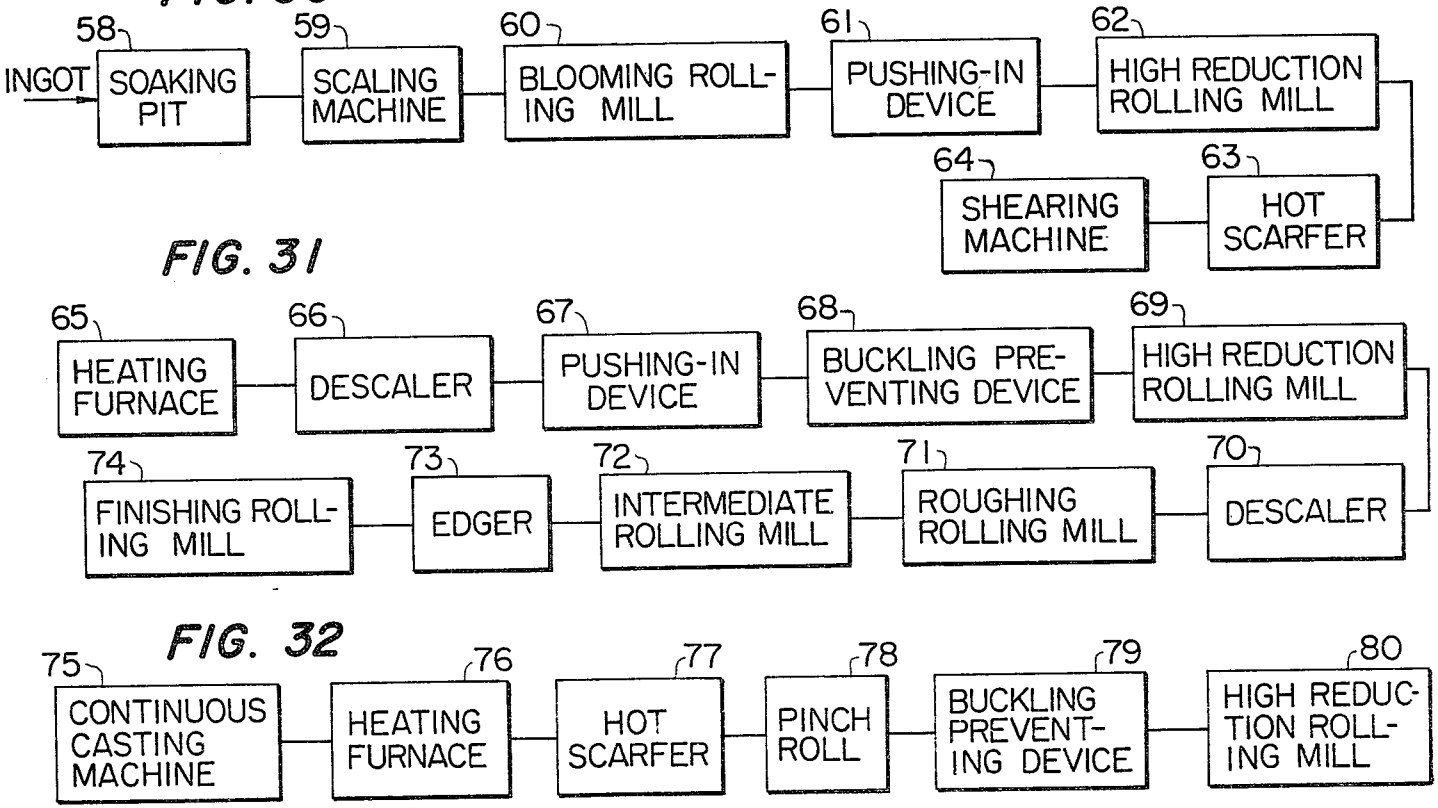

In FIG. 30, a blooming rolling mill 60 is provided after a soaking pit 58 for heating the steel ingot to the rolling temperature and a scaling machine 59. The blooming rolling mill 60 may be a normal 2-high or 3-high or a universal rolling mill. After the blooming rolling mill 60, a pushing-in device 61 and a high reduction rolling mill 62 are provided, and moreover a hot scarfer 63 and a shearing machine 64 are provided. A vertical rolling mill may be provided before the high reduction rolling mill 62, and the rolling mill may be caused to act as the pushing-in device 61. Also, the high reduction rolling mill 62 may be operated for reverse rolling. In this case, flat rolls or grooved rolls may be utilized for the vertical rolling mill. The blooming rolling mill 60 may be omitted. The position of the hot scarfer is not limited to the position as shown FIG. 30, for example, the hot scarfer may be provided before the pushing-in device 61.

Rolling apparatus for steel bar

In FIG. 31, after a heating furnace 65 for heating the bloom to the rolling temperature and a descaler 66, a pushing-in device 67, a buckling preventing device 68 and a high reduction rolling mill 69 are provided. In the high reduction rolling mill, a steel bar of fixed cross sectional shape and dimension is obtained by rolling a bloom directly after the high reduction rolling mill 69, a descaler 70, a roughing rolling mill group 71, an intermediate rolling mill group 72, an edger 73 and a finishing rolling mill group 74 are provided.

The roughing rolling mill group 71 may be replaced by one or a plurality of units of the high reduction rolling mills, and roughing rolling mill group 71, the intermediate rolling mill group 72 and/or the edger 73 may be omitted. A rolling mill for controlling the shape of the bloom may be provided after the descaler 66.

It is apparent that obvious modifications and alternations of the rolling apparatus far steel bar as shown in FIG. 31 and within the scope of this invention.

Continuous beam blank producing apparatus

In FIG. 32 a heating a furnace 76 for heating casting to the rolling temperature, and a hot scarfer 77 are provided at the output side for a continuous casting machine 75, and pinch rolls 78 for applying the pushing-in force to the casting a buckling preventing device 79 and a high reduction rolling mill 80 are provided in succession. Instead of the pinch rolls 78, a vertical rolling mill, an universal rolling mill or an edger may be utilized. The high reduction rolling mill 80 rolls the casting in one pass to the required cross sectional shape and dimension.

The foregoing rolling apparatus with the provision of the high reduction rolling mill reduces greatly the required number of apparatuses due to the shortening of the rolling line. The work efficiency can be greatly improved and a saving of energy can be effected by the reduction of the numbers of passes and the continuation of the casting operations, blooming operations, and hot rolling operations. Also, the products of various cross sectional shapes and dimensions can be rolled from the one blank, the intensive use of the blanks can be effected and also the stock yard for blanks can be reduced in area. Furthermore, it is economical from the standpoint of heat as the rolling can be performed by utilizing heat remaining in the casting or the steel ingot. Also, not only can an improvement of the productivity be obtained but also an improvement of the product quality and yield can be obtained because continuous hot rolling operations become possible. Especially, in the rolling including rolling the side faces of the workpiece by the edger and controlling width of the workpiece by adjusting the pushing-in force and the reduction rate in the high reduction rolling mill, fine profiles of the fish and tail portions of the product can be obtained, and therefore the yield can be greatly increased.

What is claimed is:

1. A method of rolling a steel workpiece by using a rolling mill having opposed working rolls in a fixed position relative to the direction of travel of the workpiece and at a fixed spacing from each other, which method comprises rolling the workpiece between the working rolls while driving said rolls and continuously exerting on the workpiece a force in the direction of movement of the workpiece through the rolling mill in addition to the force exerted in the direction of rolling by the working rolls within the surface of contact of the working rolls and the workpiece and which additional force in the direction of movement of the workpiece is less than that necessary to stress the workpiece beyond its yield point under the conditions of rolling and having a value $\sigma_p \times A$ where A is the cross-sectional area of the workpiece and $\sigma_p$ is the additional exerted force per unit area of the workpiece and is represented by:

$$1 > \frac{\sigma_p}{K} \geqq \frac{1}{a\mu}(\theta - C_1) - \frac{b}{a} > 0$$

where:

K: Yield stress (kg/mm$^2$) of the workpiece at the rolling temperature $\theta$: Contact angle of the working roll (rad)

*a*: Constant

*b*: Constant $C_1$: Constant $\mu$: Coefficient of friction between the working roll and the workpiece $\mu = [C_2(1.05 - 0.0005.T) - 0.056 \cdot V_R]\, C_3$ $C_2$: Constant determined according to the material of the working roll; 1.0 in the case of a forged steel roll; 0.8 in the case of a cast steel roll $C_3$: Constant determined according to the roll lubrication = 1 ~ 0.1

$V_R$: Rolling speed (m/sec)

T: Rolling temperature (°C)

whereby an elongation of the workpiece is produced which is much greater than the arithmetic sum of the elongation which would be produced by the driven working rolls alone and the elongation produced by the force in the direction of movement of the workpiece alone for moving the workpiece through non-driven rolls.

2. The rolling method mentioned in claim 1, wherein said workpiece is a steel bar or wire rod, and said reduction rate of the cross-sectional area more than 30%.

3. A method of rolling a workpiece as claimed in claim 1 in which the step of exerting the additional force comprises pushing the workpiece.

4. A method as claimed in claim 3 in which the workpiece is pushed at the end of the workpiece.

5. The rolling method mentioned in claim 1, further comprising adjusting the reduction rate in cross-sectional area and the pushing force to control the width of the workpiece, whereby the workpiece can be rolled into the product of required dimensions.

6. The rolling method mentioned in claim 5, wherein said workpiece is steel plate, and said pushing force is so adjusted that the compressive stress caused by said pushing force has a value $\sigma_p$ and said reduction rate $\eta$ represented by:

$$\frac{B}{Bo} = \left\{1 + a\left(\frac{\sigma p}{K}\right)\right\}(b\eta^n + c)$$

where: $a = d\eta + f$

*b* : constant = 0.1 ~ 2.5

*c* : constant = 0.5 ~ 1.5

*d* : constant = 0.9 1.2

*f* : constant = 0.2 0.4

*n* : constant = 1.5 2.5

, thereby controlling the lateral spreading of said plate.

7. The rolling method mentioned in claim 5, wherein said workpiece is a flanged steel shape, and said pushing force is so adjusted that the compressive stress caused by said pushing force has a value $\sigma$p represented by:

$$H_1 = \frac{1}{C_F} - \frac{HoBo - TwBw}{B - Bw}$$

where:

Ho : thickness of the workpiece before rolled

Bo : width of the workpiece before rolled $H_1$ : desired flange width

B : web width tw : web thickness
Bw : width of web inside $$C_F = a\eta + b\left(\frac{\sigma p}{K}\right) + d$$

a : constant = 0.5 ~ 6.0
b : constant = −0.1 ~ −6.0
d : constant = 1 ~ 4

: seb reduction rate
$$= \frac{(Ho - tw)}{Ho}$$

, whereby controlling the lateral spreading of said flange.

8. The rolling method mentioned in claim 1, in which said additional force comprises both a pushing and a pulling force, said pulling force pulling said workpiece on the outlet side of the rolling mill and adjusting said pulling force together with said pushing force, thereby controlling the lateral spreading of the workpiece.

9. The rolling method mentioned in claim 8, wherein said workpiece is steel plate; and said pushing force and said pulling force are so adjusted that the compressive stress caused by said pushing force has a value $\sigma$p represented by:

$$\frac{B}{Bo} = \left\{1 + a\left(\frac{\sigma p}{K}\right)\right\}(b\eta^n + C)$$

where:
$a = a + f$
$b$ : constant = 0.1 ~ 2.5
$c$ : constant = 0.5 ~ 1.5
$d$ : constant = 0.9 ~ 1.2
$f$ : constant = 0.2 ~ 0.4
$\eta$: web reduction rate = (Ho − tw/Ho)
$n$ : constant = 1.5 ~ 2.5
, and the tensile stress caused by said pulling force has a value $\sigma$t represented by:

$$\frac{B}{Bo} = g\left(\frac{\sigma t}{K}\right) + \left(\frac{B}{Bo}\right)_{\sigma t = 0}$$

, where:
Bo : width of the workpiece before rolled
B : width of the workpiece of the rolled
$(B/Bo)_{\sigma p = 0}$: lateral spreading rate at tensile stress $\sigma$t = 0
g : constant = −0.05 ~ −0.8
, thereby controlling the lateral spreading of said plate.

10. The rolling method mentioned in claim 8, wherein said workpiece is a flanged steel shape; and said pushing force and said pulling force are so adjusted that the compressive stress caused by said pushing force has a value $\sigma$p represented by:

$$H_1 = \frac{1}{C_F}\ \frac{HoBo - TwBw}{B - Bw}$$

where:

$$C_F = a_1\eta + b_1\left(\frac{\sigma p}{K}\right) + d$$

$a_1$ : constant = 0.5 ~ 6.0
$b_1$ : constant = −0.1 ~ −6.0
$d$ : constant = 1 ~ 4
$\eta$ : web reduction rate = (Ho − tw/Ho)
Ho : thickness of the workpiece before rolled
Bo : width of the workpiece before rolled
$H_1$ : desired flange width
B : web width
$tw$ : web thickness
$Bw$ : width of web inside
, and the tensile stress caused by said pulling force has a value Ot represented by:

$$\frac{H_1}{Ho} = a_2\left(\frac{\sigma t}{K}\right) + \left(\frac{H}{Ho}\right)_{\sigma t = 0}$$

, where
K : yield stress of the workpiece at the rolling temperature
Ho : desired flange width
$H_1$ : desired flange width
$(H_1/Ho)_{\sigma t = 0}$: lateral spreading rate of flange at tensile stress $\sigma$t = 0
, thereby controlling the lateral spreading of said flange,

11. The rolling method claimed in claim 8, wherein the rolling mill has a first pair of rolls, a second pair of rolls and a third pair of rolls, said pairs of rolls being in tandem, and the pushing force is exerted on the workpiece by controlling the first pair of rolls and the second pair of rolls so that the workpiece speed at the outlet of the first pair of rolls is faster than that at the inlet of the second pair of rolls and the pulling force is exerted on the workpiece by controlling the surface speeds of the working rolls of the second pair of rolls and the third pair of rolls so that the workpiece speed at the inlet of the third pair of rolls is faster than at the outlet of the second pair of rolls and the width of the workpiece is controlled by adjusting the magnitude of the pushing force and the pulling force.

* * * * *